US007938619B2

(12) United States Patent
Kawasaki et al.

(10) Patent No.: US 7,938,619 B2
(45) Date of Patent: May 10, 2011

(54) TURBO VACUUM PUMP

(75) Inventors: Hiroyuki Kawasaki, Tokyo (JP); Shinichi Sekiguchi, Tokyo (JP)

(73) Assignee: Ebara Corporation, Tokyo (JP)

( * ) Notice: Subject to any disclaimer, the term of this patent is extended or adjusted under 35 U.S.C. 154(b) by 72 days.

(21) Appl. No.: 12/320,356

(22) Filed: Jan. 23, 2009

(65) Prior Publication Data

US 2009/0142183 A1 Jun. 4, 2009

Related U.S. Application Data

(62) Division of application No. 11/411,896, filed on Apr. 27, 2006, now Pat. No. 7,645,116.

(30) Foreign Application Priority Data

Apr. 28, 2005 (JP) ..... 2005-133726
Jan. 18, 2006 (JP) ..... 2006-009650

(51) Int. Cl.
*F01D 1/10* (2006.01)

(52) U.S. Cl. ..... 415/143; 415/55.1

(58) Field of Classification Search ..... 415/143, 415/55.1, 55.5, 55.2, 55.6, 71, 72, 198.1, 415/199.4, 199.6, 199.3, 199.2, 90
See application file for complete search history.

(56) References Cited

U.S. PATENT DOCUMENTS 3,947,193 A 3/1976 Maurice
RE33,129 E 12/1989 Mase et al.
5,052,887 A 10/1991 Novikov et al.
6,468,030 B2 10/2002 Kawasaki
2005/0025640 A1* 2/2005 Sekiguchi et al. ..... 417/423.4

FOREIGN PATENT DOCUMENTS

| | | |
|---|---|---|
| EP | 226039 | 6/1987 |
| JP | 49-103208 | 9/1974 |
| JP | 60-125795 | 7/1985 |
| JP | 63223394 A * | 9/1988 |
| JP | 2-49996 | 2/1990 |
| JP | 2-503702 | 11/1990 |
| JP | 8-219086 | 8/1996 |

OTHER PUBLICATIONS

Japanese Office Action mailed Jul. 6, 2010 in Japanese Patent Application No. 2005-133726 together with partial English translation.

* cited by examiner

*Primary Examiner* — Edward Look
*Assistant Examiner* — Dwayne J White
(74) *Attorney, Agent, or Firm* — Wenderoth, Lind & Ponack, L.L.P.

(57) ABSTRACT

A turbo vacuum pump of the present invention includes a suction part for sucking gas in an axial direction; a discharge section in which rotating impellers and stationary impellers are alternately arranged; a rotating shaft for rotating the rotating impellers; and a turbine impeller part fixed to the suction side end face of the rotating shaft. The rotating impellers include one or more turbine impellers for discharging the sucked gas in the axial direction, and one or more centrifugal impellers, located downstream of the one or more turbine impellers, for further discharging the discharged gas by a centrifugal drag effect. The one or more centrifugal impellers are fixed to the rotating shaft passing therethrough. The one or more turbine impellers are included in the turbine impeller part.

7 Claims, 22 Drawing Sheets

TURBO VACUUM PUMP

This application is a divisional of U.S. application Ser. No. 11/411,896, filed Apr. 27, 2006, now U.S. Pat. No. 7,645,116.

BACKGROUND OF THE INVENTION

1. Technical Field

The present invention relates to a turbo vacuum pump suitable for an application in which a relatively large amount of gas is discharged or evacuated, and more particularly to a turbo vacuum pump which has a high discharge rate at a pump suction port pressure in the range of 1 to 1000 Pa.

2. Related Art

FIG. 22 shows a turbo vacuum pump IC as an example of conventional turbo vacuum pump. Currently, turbo molecular pumps are widely used as turbo vacuum pumps for processing a semiconductor in semiconductor manufacturing apparatuses or the like.

The turbo vacuum pump IC has a discharge section L including an impeller discharge section L1 and a groove discharge section L2 constituted of a rotor (rotating member) R and a stator (stationary member) S in a cylindrical pump casing 101 extending vertically.

A lower part of the pump casing 101 is surrounded by a pump base part 102 having a discharge port 120 in communication with the discharge side of the groove discharge section L2. The pump casing 101 with a suction port 101*a* has, at its upper part, a flange (not shown in FIG. 22) connectable to a device or a pipe from which gas is to be discharged. The stator S has a stationary cylindrical part 103 erected at the center of the pump base part 102 and fixed parts of both the impeller discharge section L1 and the groove discharge section L2.

The rotor R has a rotating shaft 104, which is inserted in the stationary cylindrical part 103, and a rotating cylindrical part 105 attached to the rotating shaft 104. The stationary cylindrical part 103 is housed in a hollow part 105*a* of the rotating cylindrical part 105. A driving motor 106, and an upper radial bearing 107 and a lower radial bearing 108 located above and below the driving motor 106 are disposed in a gap between the rotating shaft 104 and the stationary cylindrical part 103. An axial bearing III having a target disk 109 at the lower end of the rotating shaft 104 and upper and lower electromagnets 110*a* and 110*b* on the stator S side is located below the rotating shaft 104. This configuration allows the rotor R to rotate at a high speed under five-axis active control.

The rotating cylindrical part 105 has rotating impellers 112 integrally formed on upper and lower outer peripheries thereof to form an impeller. Stationary impeller 113 is formed on the inner surface of the pump casing and arranged alternately with the rotating impellers 112. When the rotating impellers 112 rotate at a high speed, the impeller discharge section L1 discharges gas by a reciprocal action of the rotating impellers 112 which are rotating and the stationary impellers 113 which remain stationary. The stationary impellers 113 are pressed at their peripheries from above and below and fixed with stationary impeller spacers 114.

The groove discharge section L2 is located under the impeller discharge section L1. That is, the stator S has a spiral groove part spacer 119 surrounding the rotor R and having a spiral groove 119*a*. The groove discharge section L2 discharges gas by a drag effect of the spiral groove 119*a* facing the rotor R rotating at a high speed (Patent Document 1, for example).

By placing the groove discharge section L2 downstream of the impeller discharge section L1, a wide range turbo vacuum pump IC which can operate over a wide range of flow rate can be achieved. Although the spiral groove of the groove discharge section L2 is formed on the stator S in this example, the spiral groove can be alternatively formed on the rotor R in some cases.

As described above, a composite type turbo vacuum pump having a combination of a turbine impeller as a rotating impeller which can discharge gas efficiently in a molecular flow region and a rotor with a spiral groove which can discharge gas in an intermediate flow region has become mainstream. Such a composite type turbo vacuum pump is suitable for an application in which a relatively large amount of gas flows.

The conventional turbo vacuum pump, however, has a feature that the gas discharge rate droops with an increase of pump suction pressure in a high-pressure region of 1 Pa or higher. Therefore, a large-size pump is required to cope with a high flow rate and a low pressure.

It is needless to say that the rotating cylindrical member is to be rotated at as high a speed as possible to improve the discharge performance of the turbo vacuum pump. In a general turbo molecular pump, however, the rotating cylindrical member constituting an impeller surrounds a stationary cylindrical member constituting a stator. Thus, the rotational speed of a turbo vacuum pump is limited by the stress which is generated in the maximum inner diameter part of the rotating cylindrical member. Since the conventional turbo vacuum pump has a limitation on its rotational speed, a pump with a high discharge rate, that is, a pump having a large-diameter turbine impeller is required to achieve a relatively high flow rate and a low pressure, resulting in an increase in size of the pump.

Also, since the rotating cylindrical member is formed as described above, the rotating cylindrical member is required to have a structure of a unitary body. Therefore, when a part of the rotating cylindrical member is damaged, deformed or corroded, it is highly possible that the entire rotating cylindrical member needs to be replaced. This is disadvantageous for long-term use.

In view of the above problems, it is an object of the present invention to provide a turbo vacuum pump in which rotating impellers with high discharge efficiency can be rotated at a higher speed in a pressure range of 1 to 1000 Pa to achieve a high flow rate and a low pressure, that is, a high discharge rate without a large-diameter pump impeller and which is advantageous for long-term use.

SUMMARY OF THE INVENTION

In order to achieve the above object, a turbo vacuum pump 1 of the present invention comprises, as shown in FIG. 1 for example, a suction part 23A for sucking gas in an axial direction; a discharge section 50 in which rotating impellers 70, 24 and stationary impellers 71, 28 are alternately arranged; a rotating shaft 21 for rotating the rotating impellers 70, 24; and a turbine impeller part 73 fixed to the suction part side end face 15 of the rotating shaft 21. The rotating impellers 70,24 include one or more turbine impellers 70 for discharging the sucked gas in the axial direction, and one or more centrifugal impellers 24, located downstream of the one or more turbine impellers 70, for further discharging said discharged gas by a centrifugal drag effect. The one or more centrifugal impellers 24 are fixed to the rotating shaft 21 passing therethrough, and said one or more turbine impellers 70 are included in said turbine impeller part 73.

In this configuration, the gas is sucked in an axial direction through the suction part and discharged by a reciprocal action of the rotating impeller, which is rotating at a high speed, and the stationary impeller, which remains stationary. The sucked gas is discharged in an axial direction by one or more turbine impellers and then discharged by a centrifugal drag effect caused by one or more centrifugal impellers.

When the turbine impeller which exhibits high discharge efficiency in a relatively low pressure range and the centrifugal impeller which exhibits high discharge efficiency in a relatively high pressure range are combined to constitute a turbo vacuum pump, the discharge efficiency of the entire pump can be improved. Also, since the centrifugal impeller discharges the gas radially, the length of flow passage can be increased without increasing the axial length of the pump. Accordingly, since the length of the part of the rotating shaft on which the turbine impeller and the centrifugal impeller are mounted can be small to increase the natural frequency of the entire rotor, high-speed rotating can be achieved easily.

When the centrifugal impeller is fixed to the rotating shaft extending therethrough, the diameter of the boss part of the centrifugal impeller can be small. Also, since flows in radial directions can be created and the length of flow passages can be increased, the compression performance can be improved. When the turbine impeller part is fixed to the suction part side end face of the rotating shaft, the diameter of the boss part of the turbine impeller part can be small to decrease the centrifugal force which is applied to the boss part of the turbine impeller part. Therefore, high-speed rotation can be achieved. As a result, even when a large amount of gas is sucked, the suction pressure can be decreased by the discharge effect of the turbine impeller and the gas can be compressed to a high pressure by the discharge effect of the centrifugal impeller. Further, this structure allows the turbine impeller part and the centrifugal impeller to be formed separately. Therefore, when any of the rotating impellers has damage, deformation or corrosion, only the damaged, deformed or corroded parts can be replaced and there is no need to replace all the rotating impellers. Accordingly, the turbo vacuum pump is advantageous for long term use.

In the turbo vacuum pump 1 of the present invention, as shown in FIG. 10 for example, at least one stage of the one or more centrifugal impellers may be a circumferential flow impeller. In this configuration, the turbo vacuum pump has high compression performance and can generate a high back pressure. Especially, when the centrifugal impeller is a circumferential flow impeller in a high pressure range, the effectiveness can be further improved.

In the turbo vacuum pump 1 of the present invention, as shown in FIG. 1 for example, the last stage of the one or more turbine impellers 70 may be located on the side of the suction part 23A of the suction part side end face 15 in the axial direction.

In this configuration, the diameter of the boss part of the turbine impeller part can be small. Therefore, the centrifugal force which is applied to the boss part of the turbine impeller part can be decreased and high-speed rotation can be achieved more effectively. The last stage turbine impeller is located on the suction part side of the suction part side end face of the rotating shaft in the axial direction, and this includes the case where the discharge section side end face of the last stage turbine impeller is located at the same position as the suction part side end face of the rotating shaft in the axial direction. When the turbo vacuum pump has one turbine impeller or one centrifugal impeller, this turbine impeller or centrifugal impeller is to be interpreted as the first stage one or the last stage one as needed. The last stage turbine impeller is one positioned farthest away from the suction part in case a plurality of turbine impellers are provided.

In the turbo vacuum pump 1 of the present invention, as shown in FIG. 2 for example, the minimum outside diameter Dtmin of the one or more turbine impellers 70 located on the side of the suction part from the suction part side end face 15 in the axial direction may be greater than the maximum outside diameter Dgmax of the one or more centrifugal impellers 24.

In this configuration, the discharge performance of the turbine impeller having the minimum outside diameter can be improved. Therefore, the turbo vacuum pump can have high discharge performance. When the turbo vacuum pump has one turbine impeller or one centrifugal impeller, the outside diameter of this turbine impeller or centrifugal impeller is to be interpreted as the maximum one or the minimum one as needed.

In the turbo vacuum pump 1 of the present invention, as shown in FIG. 1 for example, the turbine impeller part 73 may have a hollow part 12 and a through hole 58 formed in the bottom 12B of the hollow part 12 and be secured to the suction part side end face 15 by a screw member 78 inserted in the through hole 58. The inside diameter of the hollow part 12 may be smaller than the outside diameter of said rotating shaft 21.

In this configuration, the turbine impeller part can be securely attached to the suction part side end face with a simple structure. Also, when the inside diameter of the hollow part of the turbine impeller part is smaller than the outside diameter of the rotating shaft, the stress which is generated in the inner peripheral part of the hollow part is small. Since excessive stress is not generated in the hollow part, high-speed rotation can be achieved.

In the turbo vacuum pump 1 of the present invention, as shown in FIG. 8 for example, the turbine impeller part 73 may have a discharge section side end face 11B in contact with the suction part side end face 15, and a projection 85 with threads formed on the discharge section side end face 11B. The rotating shaft 21 may have a cavity 84, in the suction part side end face 15, with threads for threadedly receiving the projection 85.

In this configuration, there is no need to form a through hole for attaching the turbine impeller part to the suction part side end face of the rotating shaft. Therefore, the stress which is generated in the boss part of the turbine impeller part can be reduced, and high-speed rotation can be achieved more reliably.

In the turbo vacuum pump 1 of the present invention, as shown in FIG. 8 for example, the turbine impeller part 73 may be solid. In this configuration, the stress which is generated in the boss part of the turbine impeller part can be reduced, and higher-speed rotation can be achieved more reliably.

In the turbo vacuum pump 1 of the present invention, as shown in FIG. 7 for example, the turbine impeller part 73 may have a discharge section side end face 11B in contact with the suction part side end face 15 and an annular projection 83 formed on the discharge section side end face 11B for receiving the rotating shaft 21.

In this configuration, the annular projection enables the turbine impeller part to be easily positioned concentrically with the rotating shaft and to be attached, without being tilted, with its axis coincident with the axis of the rotating shaft. Therefore, the turbine impeller part can be prevented from increasing unbalance and can remain stable during high-speed rotation.

When one or more turbine impellers which exhibit high discharge efficiency in a relatively low pressure range and one or more centrifugal impellers which exhibit high discharge efficiency in a relatively high pressure range are combined to constitute a turbo vacuum pump in the present invention, the discharge efficiency of the entire pump can be improved. Also, since the centrifugal impeller discharges the gas radially, the length of the flow passage can be increased without increasing the axial length of the pump. Accordingly, since the length of the part of the rotating shaft on which the turbine impeller and the centrifugal impeller are mounted can be small to increase the natural frequency of the entire rotor, high-speed rotating can be achieved easily. Also, when the centrifugal impeller is fixed to the rotating shaft extending therethrough, the diameter of the boss part of the centrifugal impeller can be small. Also, since flows in radial directions can be created and the length of flow passages can be increased, the compression performance can be improved. When the turbine impeller is secured to the suction part side end face of the rotating shaft, the diameter of the boss part of the turbine impeller part can be small to decrease the centrifugal force which is applied to the boss part of the turbine impeller part. Therefore, high-speed rotation can be achieved. As a result, even when the amount of the gas is large, the suction pressure can be decreased by the discharge effect of the turbine impellers and the gas can be compressed to a high pressure by the discharge effect of the centrifugal impeller. Further, this structure allows the turbine impeller part and the centrifugal impeller to be formed separately. Therefore, when any of the rotating impellers has damage, deformation or corrosion, only the damaged, deformed or corroded parts can be replaced and there is no need to replace all the rotating impellers. Accordingly, the pump is advantageous for long term use.

In order to achieve the above object, a turbo vacuum pump 1-2 of the present invention comprises, as shown in FIG. 13 for example, a suction part 23A for sucking gas in an axial direction; a discharge section 50 in which rotating impellers 70, 24 and stationary impellers 71, 28 are alternately arranged; and a rotating shaft 21 for rotating the rotating impellers 70,24. The rotating impellers 70, 24 include one or more turbine impellers 70 for discharging the sucked gas in the axial direction, and one or more centrifugal impellers 24, located downstream of the one or more turbine impellers 70, for further discharging said discharged gas by a centrifugal drag effect, and the one or more centrifugal impellers 24 are fixed to the rotating shaft 21 passing therethrough. A round tubular ring 41 is disposed between the one or more centrifugal impeller 24 and the rotating shaft 21, and fitted on the rotating shaft 21 by shrink fit.

In this configuration, the gas is sucked in an axial direction through the suction part and discharged by a reciprocal action of the rotating impeller rotating at a high speed and stationary impeller remaining stationary. The sucked gas is discharged in an axial direction by one or more turbine impellers and then discharged by a centrifugal drag effect caused by one or more centrifugal impellers.

When the turbine impeller which exhibits high discharge efficiency in a relatively low pressure range and the centrifugal impeller which exhibits high discharge efficiency in a relatively high pressure range are combined to constitute a turbo vacuum pump, the discharge efficiency of the entire pump can be improved. Also, since the centrifugal impeller discharges the gas radially, the length of flow passage can be increased without increasing the axial length of the pump. Accordingly, since the length of the part of the rotating shaft on which the turbine impeller and the centrifugal impeller are mounted can be small to increase the natural frequency of the entire rotor, high-speed rotating can be achieved easily.

When the centrifugal impeller is fixed to the rotating shaft extending therethrough, the diameter of the boss part of the centrifugal impeller can be small. Also, since flows in radial directions can be created and the length of flow passages can be increased, the compression performance can be improved. Also, when the pump has a round tubular ring disposed between the centrifugal impeller and the rotating shaft and shrink-fitted on the rotating shaft, the bending rigidity of the rotating shaft with a round tubular ring shrink-fitted thereon can be improved and high speed rotation can be achieved. As a result, even when a large amount of gas is sucked, the suction pressure can be decreased by the discharge effect of the turbine impeller and the gas can be compressed to a high pressure by the discharge effect of the centrifugal impeller.

The turbo vacuum pump 1 of the present invention, as shown in FIG. 13 for example, may comprise a turbine impeller part 73 fixed to the suction part side end face 15 of the rotating shaft 21. The one or more turbine impellers 70 are included in the turbine impeller part 73.

When the turbine impeller part is fixed to the suction part side end face of the rotating shaft, the diameter of the boss part of the turbine impeller part can be small to decrease the centrifugal force which is applied to the boss part of the turbine impeller part. Therefore, high-speed rotation can be achieved. As a result, even when a large amount of gas is sucked, the suction pressure can be decreased by the discharge effect of the turbine impeller and the gas can be compressed to a high pressure by the discharge effect of the centrifugal impeller. Further, this structure allows the turbine impeller part and the centrifugal impeller to be formed separately. Therefore, when any of the rotating impellers has damage, deformation or corrosion, only the damaged, deformed or corroded impellers can be replaced and there is no need to replace all the rotating impellers. Accordingly, the pump is advantageous for long term use.

In order to achieve the above object, a turbo vacuum pump 1 of the present invention comprises, as shown in FIG. 13 and FIG. 14 for example, a suction part 23A for sucking gas in an axial direction; a discharge section 50 in which rotating impellers 70, 24 and stationary impellers 71, 28 are alternately arranged; a rotating shaft 21 for rotating the rotating impellers 70,24, the rotating impellers 70, 24 including one or more turbine impellers 70 for discharging said sucked gas in the axial direction, and one or more centrifugal impellers 24, located downstream of the one or more turbine impellers 70, for further discharging the discharged gas by a centrifugal drag effect. An axial distance LX between the last stage of the one or more turbine impellers 70 and the first stage of the one or more centrifugal impellers 24 is 12% or more of the outside diameter Dt (FIG. 16) of the last stage of the one or more turbine impellers 70.

In this configuration, the gas is sucked in an axial direction through the suction part and discharged due to a reciprocal action of the rotating impellers rotating at a high speed and the stationary impellers remaining stationary. The sucked gas is discharged in an axial direction by one or more turbine impellers and then discharged by a centrifugal drag effect caused by one or more centrifugal impellers.

When the turbine impeller which exhibits high discharge efficiency in a relatively low pressure range and the centrifugal impeller which exhibits high discharge efficiency in a relatively high pressure range are combined to constitute a turbo vacuum pump, the discharge efficiency of the entire pump can be improved. Also, since the centrifugal impeller discharges the gas radially, the length of the flow passage can be increased without increasing the axial length of the pump. Accordingly, since the length of the part of the rotating shaft on which the turbine impeller and the centrifugal impeller are mounted can be small to increase the natural frequency of the entire rotor, high-speed rotating can be achieved easily.

When the axial distance between the last stage turbine impeller and the first stage centrifugal impeller is 12% or more of the outside diameter of the last stage turbine impeller, the flowing direction of the gas, flowing axially, discharged from the last stage turbine impeller is smoothly changed to a direction toward the suction part of the first stage centrifugal impeller in the space between the last stage turbine impeller and the first stage centrifugal impeller (along axial distance). Then, the first centrifugal impeller draws the gas smoothly. Since the flowing direction of the gas can change smoothly, the pressure loss in this space is small. Therefore, the performance of the turbo vacuum pump can be improved.

In order to achieve the above object, a turbo vacuum pump 1 of the present invention comprises, as shown in FIG. 13 and FIG. 14 for example, a suction part 23A for sucking gas in an axial direction; a discharge section 50 in which rotating impellers 70, 24 and stationary impellers 71, 28 are alternately arranged; a rotating shaft 21 for rotating the rotating impellers 70, 24, the rotating impellers 70, 24 including one or more turbine impellers 70 for discharging the sucked gas in the axial direction, and one or more centrifugal impellers 24, located downstream of the one or more turbine impellers 70, for further discharging the discharged gas by a centrifugal drag effect. A partition 43 with an opening 43A is located right upstream of the first stage of one or more centrifugal impellers 24. The first stage of one or more centrifugal impellers 24 are so positioned as to draw the gas through the opening 43A, and an axial distance Ly between the last stage of the one or more turbine impellers 70 and the partition 43 is 12% or more of the outside diameter of the last stage of the one or more turbine impellers 70.

When the axial distance between the last stage turbine impeller and the partition is approximately 12% or more of the outside diameter of the last stage turbine impeller, the flowing direction of the gas, flowing axially, discharged from the last stage turbine impeller is smoothly changed to a direction toward the opening of the partition and the suction part of the first stage centrifugal impeller in the space between the last stage turbine impeller and the partition (along axial distance). Then, the first stage centrifugal impeller draws the gas smoothly. Since the flowing direction of the gas can change smoothly, the pressure loss in this space is small. Therefore, the performance of the turbo vacuum pump can be improved.

The turbo vacuum pump 1 of the present invention, as shown in FIG. 13 for example, may comprise a turbine impeller part 73 fixed to the suction part side end face 15 of said rotating shaft 21. The centrifugal impeller 24 is fixed to the rotating shaft 21 passing therethrough, and the one or more turbine impellers 70 are included in the turbine impeller part 73.

When the centrifugal impellers are fixed to the rotating shaft extending therethrough, the diameter of the boss part of the centrifugal impeller can be small. Also, since flows in radial directions can be created and the length of flow passages can be increased, the compression performance can be improved.

When the turbine impeller part is fixed to the suction part side end face of the rotating shaft, the diameter of the boss part of the turbine impeller part can be small to decrease the centrifugal force which is applied to the boss part of the turbine impeller part. Therefore, high-speed rotation can be achieved. As a result, even when a large amount of gas is sucked, the suction pressure can be decreased by the discharge effect of the turbine impeller and the gas can be compressed to a high pressure by the discharge effect of the centrifugal impeller. Further, this structure allows the turbine impeller part and the centrifugal impeller to be formed separately. Therefore, when any of the rotating impellers has damage, deformation or corrosion, only the damaged, deformed or corroded parts can be replaced and there is no need to replace all the rotating impellers. Accordingly, the pump is advantageous for long term use.

The turbo vacuum pump 1 of the present invention, as shown in FIG. 13 for example, may comprise a round tubular ring 41 which is disposed between the one or more centrifugal impellers 24 and the rotating shaft 21, and is shrink-fitted on the rotating shaft 21.

When the pump has the round tubular ring disposed between the centrifugal impeller and the rotating shaft and shrink-fitted on the rotating shaft, the bending rigidity of the rotating shaft with a round tubular ring shrink-fitted thereon can be improved and high speed rotation can be achieved. As a result, even when a large amount of gas is sucked, the suction pressure can be decreased by the discharge effect of the turbine impeller and the gas can be compressed to a high pressure by the discharge effect of the centrifugal impeller.

In the turbo vacuum pump 1 of the present invention, as shown in FIG. 13 for example, the ratio of the outside diameter of the rotating shaft 21 to the outside diameter of the round tubular ring 41 may be 75% or greater.

In this configuration, the bending rigidity of the rotating shaft with a round tubular ring shrink-fitted thereon can be improved more effectively and high speed rotation can be achieved.

When the turbine impeller which exhibits high discharge efficiency in a relatively low pressure range and the centrifugal impeller which exhibits high discharge efficiency in a relatively high pressure range are combined to constitute the turbo vacuum pump in the present invention, the discharge efficiency of the entire pump can be improved. Also, since the centrifugal impeller discharges the gas radially, the length of the flow passage can be increased without increasing the axial length of the pump. Therefore, since the length of the part of the rotating shaft on which the turbine impeller and the centrifugal impeller are mounted can be small, the natural frequency of the entire rotor is increased and high-speed rotation can be achieved easily. Accordingly, there can be provided the turbo vacuum pump in which the rotating impellers with high discharge efficiency can be rotated at a higher speed in a pressure range of 1 to 1000 Pa to achieve a high flow rate and a low pressure, that is, a high discharge rate without a large-diameter pump impeller and which is advantageous for long-term use.

When the centrifugal impeller is fixed to the rotating shaft extending therethrough, the diameter of the boss part of the centrifugal impeller can be small. Also, since flows in radial directions can be created and the length of flow passages can be increased in the centrifugal impeller, the compression performance can be improved. When the turbine impeller part is fixed to the suction side end face of the rotating shaft, the diameter of the boss part of the turbine impeller part can be small to decrease the centrifugal force which is applied to the boss part of the turbine impeller part. Therefore, high-speed rotation can be achieved. As a result, even when the amount of gas is large, the suction pressure can be decreased by the discharge effect of the turbine impeller and the gas can be compressed to a high pressure by the discharge effect of the centrifugal impeller. Further, this structure allows the turbine impeller part and the centrifugal impeller to be formed separately. Therefore, when any of the rotating impellers has damage, deformation or corrosion, only the damaged, deformed or corroded parts can be replaced and there is no need to replace all the rotating impellers. Accordingly, the pump is advantageous for long term use.

The present application is based on the Japanese Patent Application No. 2005-133726 filed on Apr. 28, 2005 in Japan, and the Japanese Patent Application No. 2006-009650 filed on Jan. 18, 2006 in Japan. These Japanese Patent Applications are hereby incorporated in their entirety by reference into the present application.

The present application will become more fully understood from the detailed description given hereinbelow. However, the detailed description and the specific embodiment are illustrated of desired embodiments of the present invention and are described only for the purpose of explanation. Various changes and modifications will be apparent to those ordinary skilled in the art of the basic of the detailed description.

The applicant has no intention to give to public any disclosed embodiment. Among the disclosed changes and modifications, those which may not literally fall within the scope of the patent claims constitute, therefore, a part of the present invention in the sense of the doctrine of equivalents.

DETAILED DESCRIPTION OF THE PREFERRED EMBODIMENT

Figure 1:
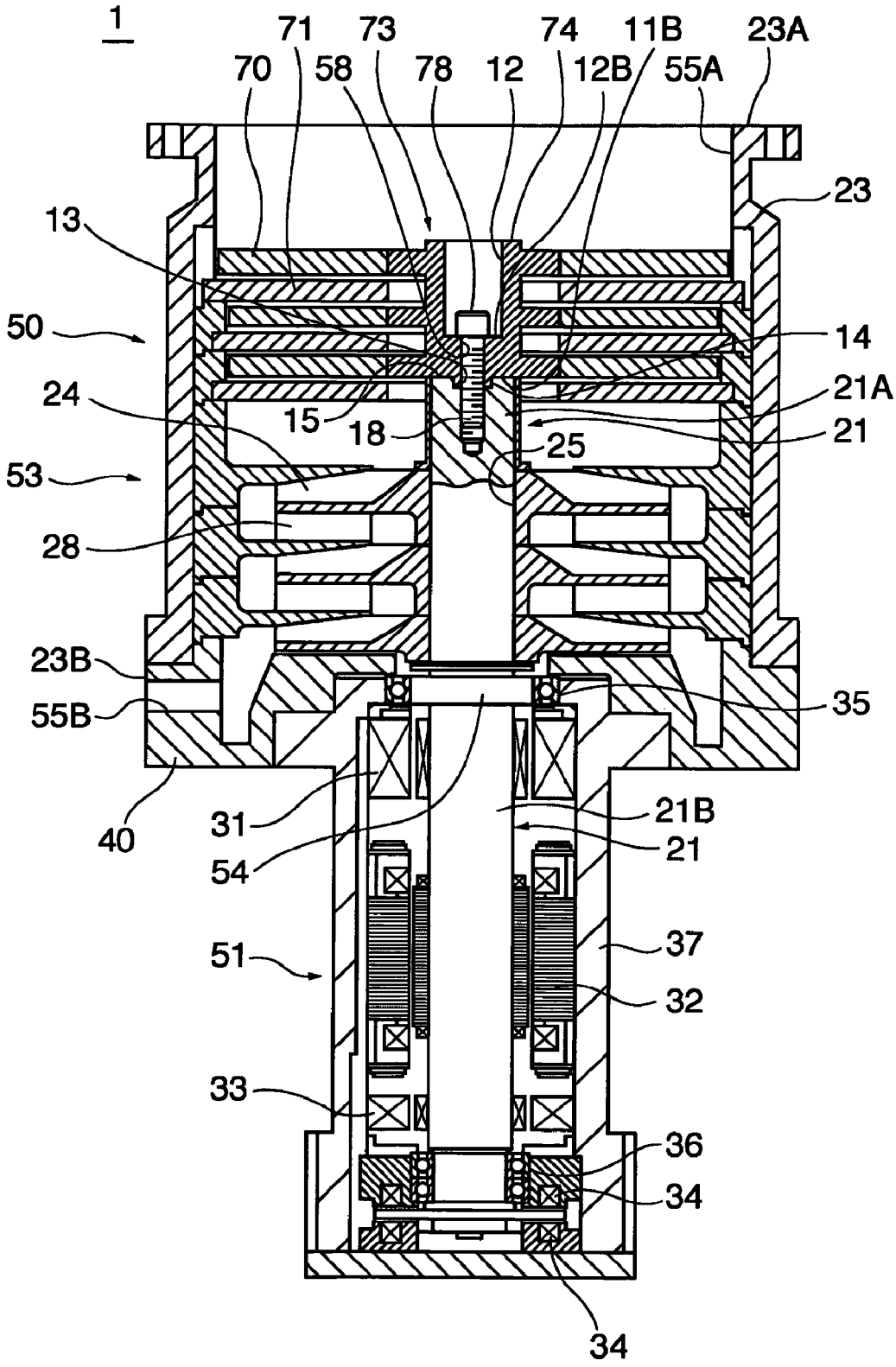
FIG. 1 is a cross-sectional front elevation of a turbo vacuum pump according to a first embodiment of the present invention.

The embodiments of the present invention are hereinafter described with reference to the drawings. The same or corresponding parts are denoted in all the drawings with the same or similar reference numerals, and redundant description is not repeated.

FIG. 1 is a cross-sectional front elevation, illustrating the configuration of a turbo vacuum pump 1 according to a first embodiment of the present invention. Description is hereinafter made with reference to the drawing. The turbo vacuum pump 1 (which may be hereinafter referred to as "pump 1" as needed) is elongated vertically and has a discharge section 50, a motion control section 51, a rotating shaft 21, and a casing 53 for housing the discharge section 50, the motion control section 51 and the rotating shaft 21. The rotating shaft 21 extends vertically and has a discharge side end part 21A on the side of the discharge section 50, a motion control side end part 21B on the side of the motion control section 51, and a disk-shaped large-diameter part 54 disposed between the discharge section side part 21A and the motion control section side part 21B.

The casing 53 has an upper housing (pump stator) 23, a lower housing 37 located below the upper housing 23 in the vertical direction (axial direction of the pump 1), and a sub-casing 40 interposed between the upper housing 23 and the lower housing 37. The upper housing 23 has a suction nozzle 23A, as a suction part, at its top, and the sub-casing 40 has a discharge nozzle 23B, as a discharge section, formed through a side thereof. The upper housing 23 houses the discharge section 50 and the discharge section side (50) part 21A of the rotating shaft 21. The suction nozzle 23A has a suction opening 55A formed therein, and the discharge nozzle 23B has a discharge opening 55B formed therein. The suction nozzle 23A sucks gas, as a fluid, (such as corrosive process gas or gas containing reaction products) vertically downward through the suction opening 55A, and the discharge nozzle 23B discharges the sucked gas horizontally through the discharge opening 55B.

The discharge section 50 has plural stages (five stages) of stationary impellers 71 and 28, a turbine impeller part 73 having plural stages (three stages) of turbine impellers 70 as rotating impellers, and plural stages (three stages) of centrifugal impellers (centrifugal drag impellers) 24 as rotating impellers. Three stages of stationary impellers 71 are respectively located right downstream of the turbine impellers 70, and two stages of stationary impellers 28 are respectively located right downstream of the first and second stage centrifugal impellers 24.

The discharge section 50 has the turbine impeller part 73 having three stages of turbine impellers 70. A boss part 74 of the turbine impeller part 73 has a hollow part 12 with a bottom 12B having a through hole 58. The hollow part 12 has an inside diameter greater than that of the through hole 58. The inside diameter of the through hole 58 is smaller than the outside diameter of the rotating shaft 21. The turbine impeller part 73 has a lower end face (discharge side end face) 11B, and a stepped part 14 protrudes from the lower end face 11B. The through hole 58 passes through the stepped part 14.

The rotating shaft 21 has a suction side end face 15 with a recess 13 at its top, and a screw hole 18 is formed in the bottom of the recess 13. The turbine impeller part 73 is secured to the suction side end face 15 by a hexagonal bolt 78 as a screw member, and the stepped part 14 of the turbine impeller part 73 is received in the recess 13 of the rotating shaft 21. The structure of the stepped part 14 receivable in the recess 13 enables the turbine impeller part 73 to be easily positioned concentrically with the rotating shaft 21 and to be attached, without being tilted, with its axis coincident with the axis of the rotating shaft 21. Therefore, the turbine impeller part 73 can be prevented from increasing unbalance and can remain stable during its high-speed rotation. The hexagonal bolt 78 extends through the through hole 58 and is inserted in the screw hole 18. The inside diameter of the hollow part 12 is slightly greater than the outside diameter of the head of the hexagonal bolt 78 and is suitable for insertion and fastening of the hexagonal bolt 78.

Each of the centrifugal impellers 24 has a fitting hole 25 at its center. The rotating shaft 21 passes through the fitting holes 25 of the centrifugal impellers 24, and the centrifugal impellers 24 are fixedly mounted on the rotating shaft 21 and stacked in layers.

The first stage centrifugal impeller 24 is located at a position apart from the suction side end face 15 of the rotating shaft 21. Although one hexagonal bolt 78 is shown in the drawing, the turbine impeller part 73 may be secured with a plurality of hexagonal bolts 78 positioned at the same distance from the axis.

The lower housing 37 houses the motion control section 51 and the motion control section side part 21B of the rotating shaft 21 on the side of the motion control section 51. The motion control section 51 has an upper protective bearing 35, an upper radial magnetic bearing 31, a motor 32 for rotatably driving the rotating shaft 21, a lower radial magnetic bearing 33, a lower protective bearing 36, and an axial magnetic bearing 34 in this order from top to bottom. The upper radial magnetic bearing 31 and the lower radial magnetic bearing 33 rotatably support the rotating shaft 21. The axial magnetic bearing 34 bears a force which is caused by the weight of the rotor and applied downward as viewed in the drawing and a thrust force which is applied upward or downward as viewed in the drawing.

The magnetic bearings 31, 33 and 34 are all active magnetic bearings. When any of the magnetic bearings 31, 33 and 34 has a failure, the upper protective bearing 35 bears the rotating shaft 21 in the radial direction of the rotating shaft 21 in place of the upper radial magnetic bearings 31, and the lower protective bearing 36 bears the rotating shaft 21 in the radial and axial directions of the rotating shaft 21 in place of the lower radial magnetic bearing 33 and the axial magnetic bearing 34.

Figure 2:
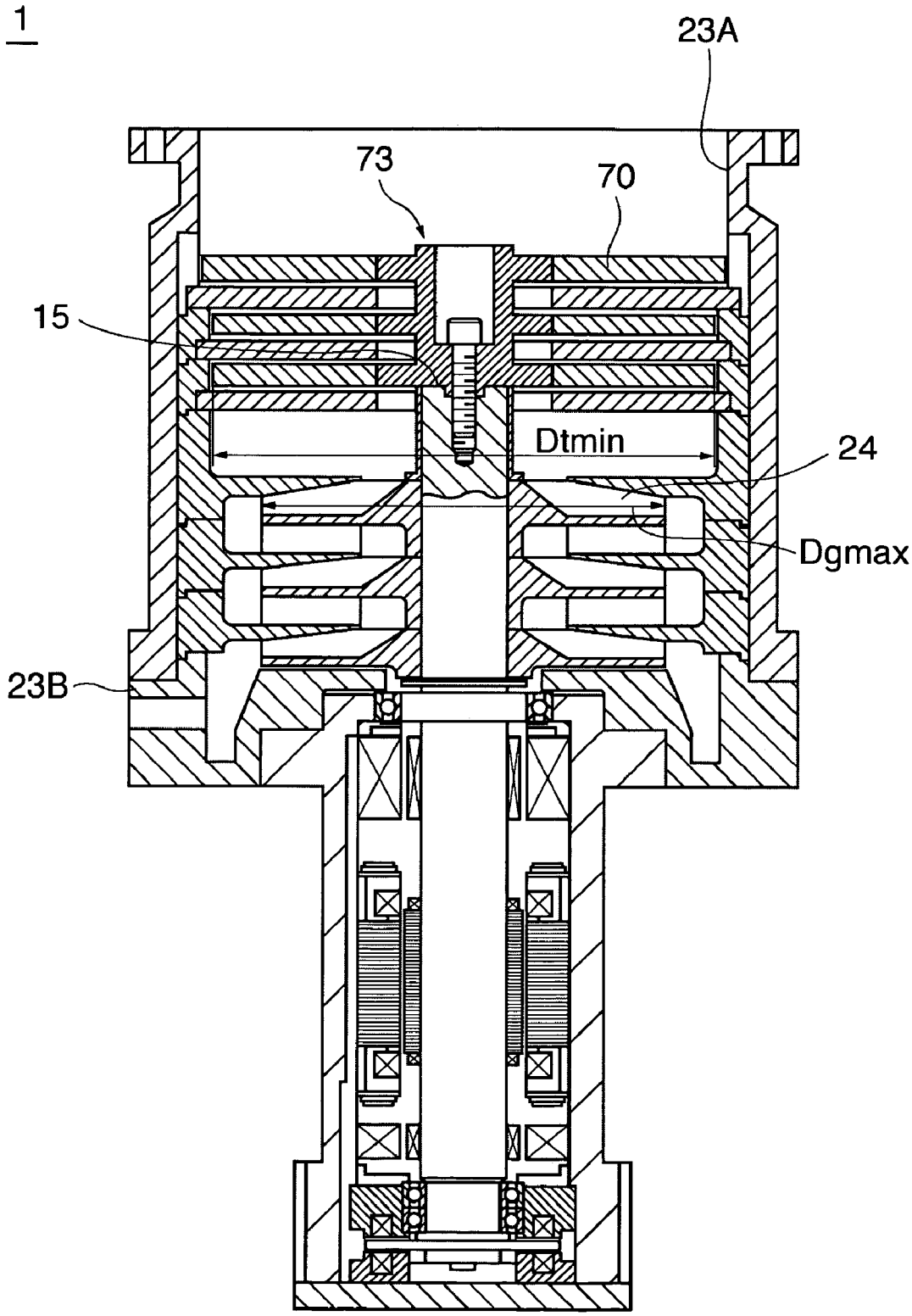
FIG. 2 is a view, describing the minimum outside diameter of turbine impeller and maximum outside diameter of centrifugal impeller in the turbo vacuum pump shown in FIG. 1.

Description is made in detail about the outside diameters of the turbine impellers 70 and the centrifugal impellers 24 with reference to FIG. 2.

The second and third stage turbine impellers 70 have the same outside diameter, which is smaller than that of the first stage turbine impeller 70. The turbine impellers 70 are all located on the suction part side (the suction nozzle 23A side) from the suction part side end face 15 of the rotating shaft 21. Thus, the last stage turbine impeller 70 (the one closest to the discharge nozzle 23B), that is, the third stage turbine impeller 70, is located on the suction side of the suction side end face 15 of the rotating shaft 21. The third stage turbine impeller 70 has an outside diameter Dtmin, which is the smallest among the outside diameters of the turbine impellers 70 located on the suction side of the suction side end face 15 in the axial direction. In general, among outside diameters of turbine impellers, the outside diameter of the last stage turbine impeller is equal to the smallest one.

The first to third stage centrifugal impellers 24 have the same outside diameter. The first stage centrifugal impeller 24 (the uppermost centrifugal impeller closest to the suction side), shown in the drawing, has an outside diameter Dgmax, which is the largest among the centrifugal impellers 24. That is, when all centrifugal impellers have the same outside diameter, the outside diameter is the maximum outside diameter. In general, when a plurality of centrifugal impellers are stacked, the first stage centrifugal impeller or the uppermost centrifugal impeller has the maximum outside diameter.

As shown in the drawing, the minimum outside diameter Dtmin of the turbine impellers 70, which are located on the suction side of the suction side end face 15 of the rotating shaft 21 in the axial direction, is greater than the maximum outside diameter Dgmax of the centrifugal impellers 24.

Figure 3A:
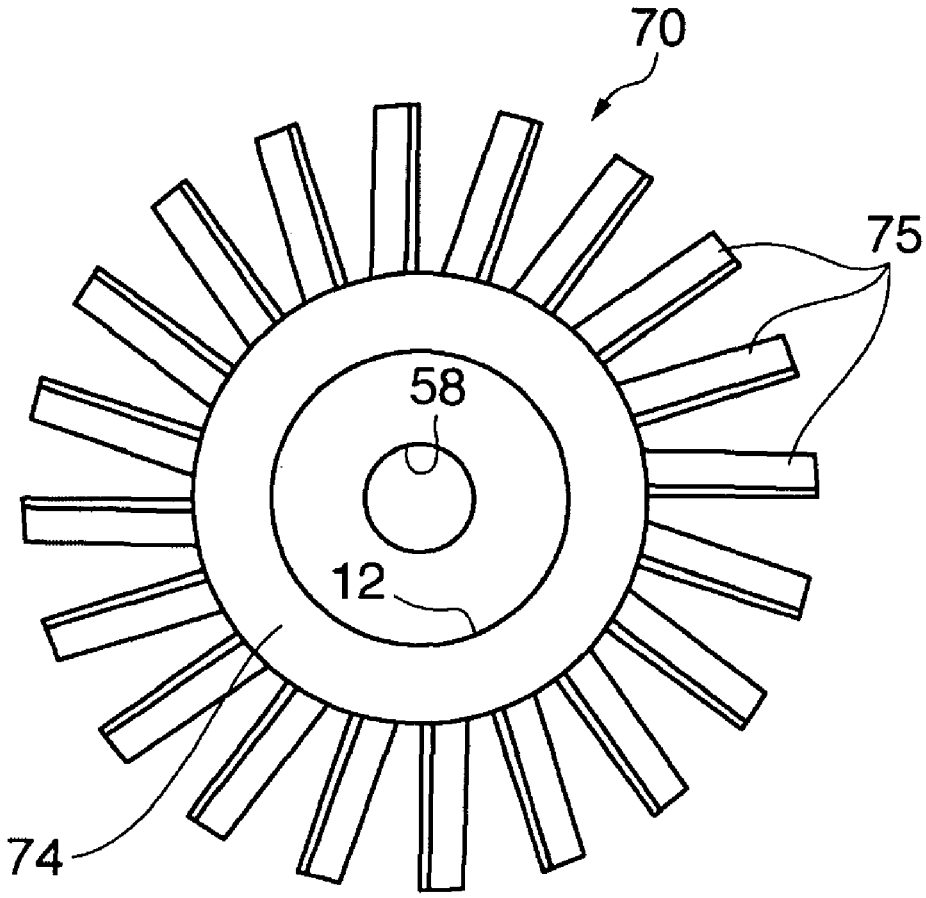
FIG. 3(*a*) is a plan view of a turbine impeller part of the turbo vacuum pump shown in FIG. 1, and FIG. 3(*b*) is an elevation view, partially developed on a plane, of a turbine impeller, looking radially toward the center thereof.
Figure 3B:
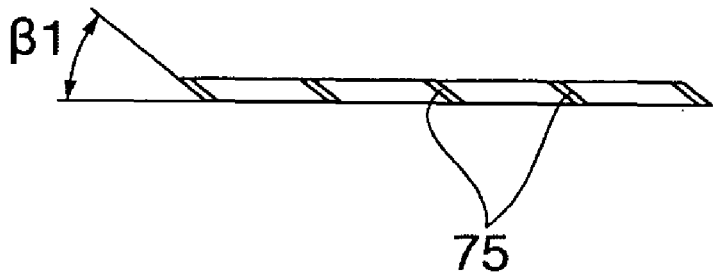

With reference to FIGS. 3(*a*) and 3(*b*), the configuration of the turbine impeller part 73 (FIG. 1) is described. FIG. 3(*a*) is an elevation view of the turbine impeller part 73, looking from the side of the suction nozzle 23A (FIG. 1). In the drawing, only the first stage turbine impeller 70 of the turbine impeller part 73 is shown and the hexagonal bolt 78 (FIG. 1) is not shown. FIG. 3(*b*) is a plan view, partially developed on a plane, of the first stage turbine impeller 70, looking radially toward the center thereof.

The turbine impeller part 73 has a boss part 74 and turbine impellers 70, thus the boss part 74 and the turbine impellers 70 are included in the turbine impeller part 73, and each of the turbine impellers 70 has a plurality of plate-like vanes 75 radially extending from the outer periphery of the boss part 74. The boss part 74 has the hollow part 12 and the through hole 58. Each vane 75 is attached with a twist angle of $\beta 1$ (10° to 40°, for example) with respect to the central axis of the rotating shaft 21. The second and third stage turbine impellers 70 (not shown in FIGS. 3(*a*) and 3(*b*)) are the same in configuration as the first stage turbine impeller 70. The number of vanes 75, the twist angle $\beta 1$ of the vanes 75, the outer diameter of the portion of the boss part 74 to which the vanes 75 are attached and the length of the vanes 75 may be changed as needed.

Figure 4A:
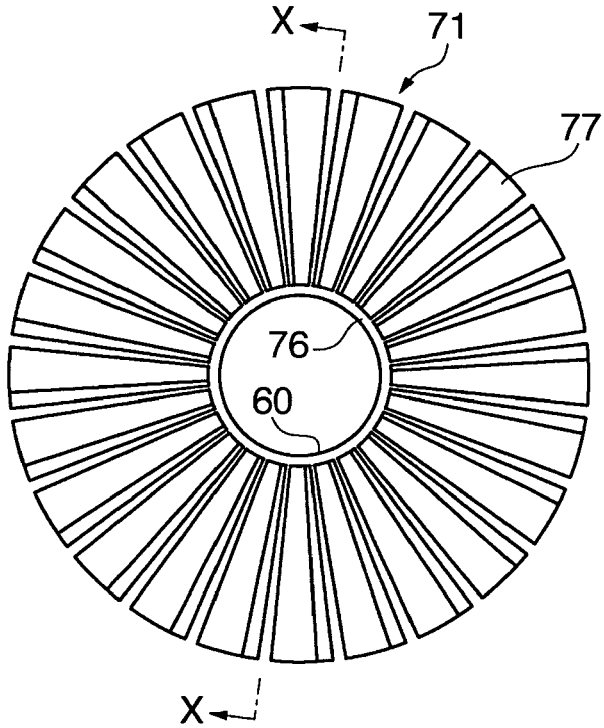
FIG. 4(*a*) is a plan view of a stationary impeller for a turbine impeller of the turbo vacuum pump shown in FIG. 1, FIG. 4(*b*) is a front view of the stationary impeller, and FIG. 4(*c*) is a cross-sectional view taken along the line X-X of FIG. 4(*a*).
Figure 4B:
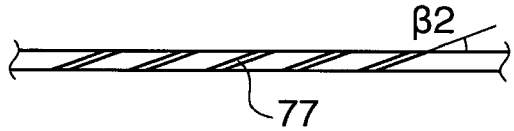
Figure 4C:
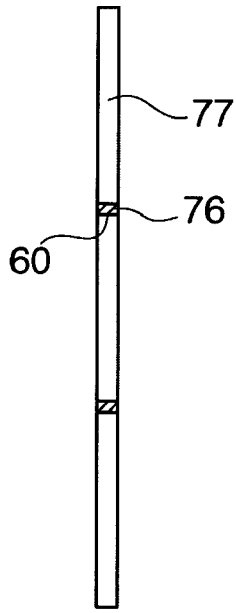

With reference to FIGS. 4(*a*), 4(*b*) and 4(*c*), the configuration of the first stage stationary impeller 71 (FIG. 1) is described. FIG. 4(*a*) is a plan view of the first stage stationary impeller 71, looking from the side of the suction nozzle 23A. FIG. 4(*b*) is a side elevation view, partially developed on a plane, of the first stage stationary impeller 71, looking radially toward the center thereof. FIG. 4(*c*) is a cross-sectional view, taken along the line X-X of FIG. 4(*a*).

The stationary impeller 71 has an annular part 76 with an annular shape, and plate-like vanes 77 radially extending from the outer periphery of the annular part 76. The inner periphery of the annular part 76 defines a shaft hole 60, and the rotating shaft 21 (FIG. 1) passes through the shaft hole 60. Each vane 77 is attached with a twist angle of β2 (10° to 40°, for example) with respect to the central axis of the rotating shaft 21. The second and third stage stationary impellers 71 (not shown in FIGS. 4(*a*), 4(*b*) and 4(*c*)) are the same in configuration as the first stage stationary impeller 71. The number of the vanes 77, the twist angle β2 of vanes 77, the outer diameter of the annular part 76 and the length of the vanes 77 may be changed as needed.

Figure 5A:
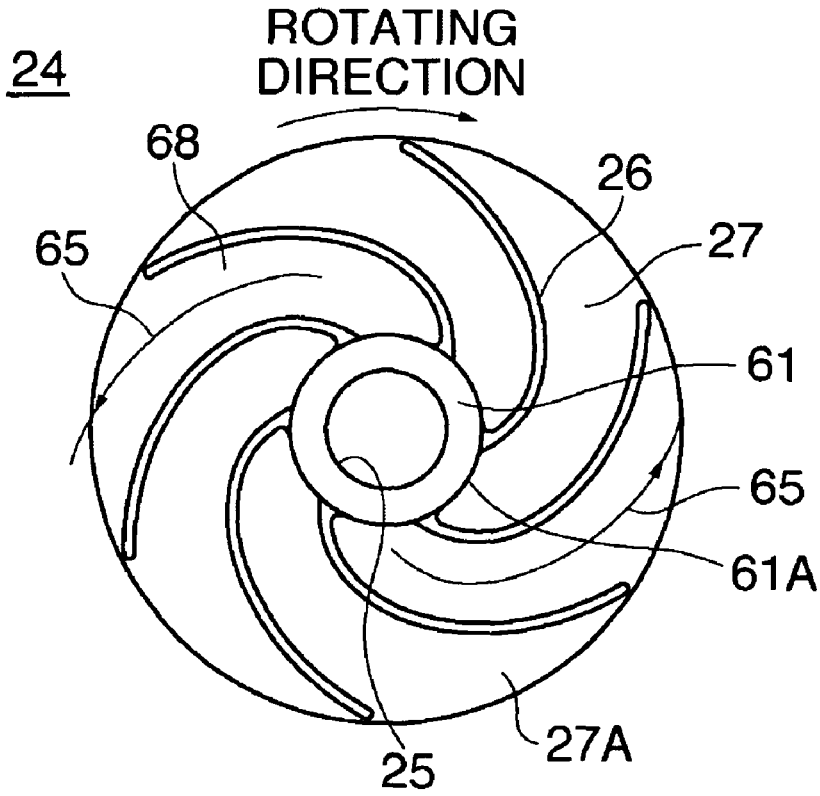
FIG. 5(*a*) is a plan view of a centrifugal impeller of the turbo vacuum pump shown in FIG. 1, and FIG. 5(*b*) is a cross-sectional front view of the centrifugal impeller.
Figure 5B:
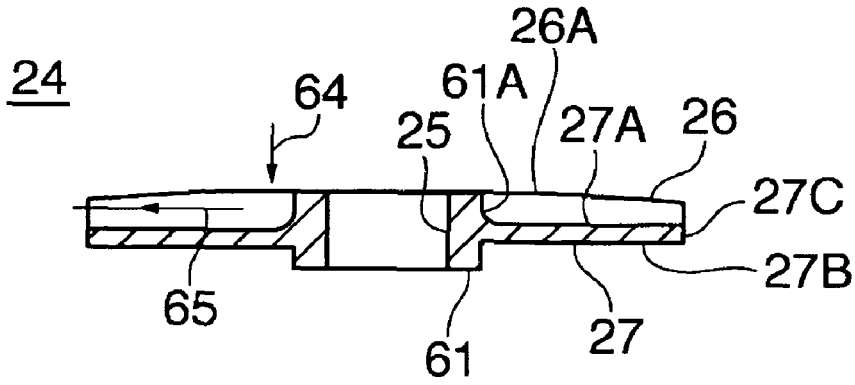

With reference to FIGS. 5(*a*) and 5(*b*), the configuration of the centrifugal impellers 24 (FIG. 1) is described. FIG. 5(*a*) is a plan view of the first stage centrifugal impeller 24, looking from the side of the suction nozzle 23A (FIG. 1), and FIG. 5(*b*) is a cross-sectional front view of the first stage centrifugal impeller 24. The first stage centrifugal impeller 24 has a generally disk-shaped base part 27 with a boss part 61, and spiral vanes 26 fixed on a front side 27A or one face of the base part 27. The rotating direction of the centrifugal impellers 24 is clockwise in FIG. 5(*a*).

As shown in FIG. 5(*a*), the centrifugal impeller 24 has a plurality (six) of spiral vanes 26. The spiral vanes 26 extend in such a direction as to cause the gas to flow counter to the direction of rotation (in a direction opposite the direction of rotation). Each of the spiral vanes 26 has a front end face 26A on the suction side and extends from an outer peripheral surface 61A of the boss part 61 to an outer peripheral part 27C of the base part 27. The other side of the centrifugal impeller 24 opposite the front side 27A is a reverse (or back) side 27B. The front side 27A and the back side 27B are, for example, perpendicular to the central axis of the rotating shaft 21 (FIG. 1). The fitting hole 25 described above is formed in the boss part 61. The second and third stage centrifugal impellers 24 (not shown in FIGS. 5(*a*) and 5(*b*)) are the same in configuration as the first stage centrifugal impeller 24. The number and shape of the vanes 26, the outside diameter of the boss part 61, and the length of flow passages defined by the spiral vanes 26 may be changed as needed.

The centrifugal impellers 24 can be made by machining, such as end milling a disk-shaped blank (not shown) to form the spiral vanes 26 protruding from the base part 27. This is the most popular method to fabricate impellers for high-speed rotation (at a peripheral speed of 300 to 600 m/s) from the viewpoint of the improvement of dimensional accuracy and the use of a material with high specific strength (such as aluminum alloy, titanium alloy or ceramics, etc).

Figure 6A:
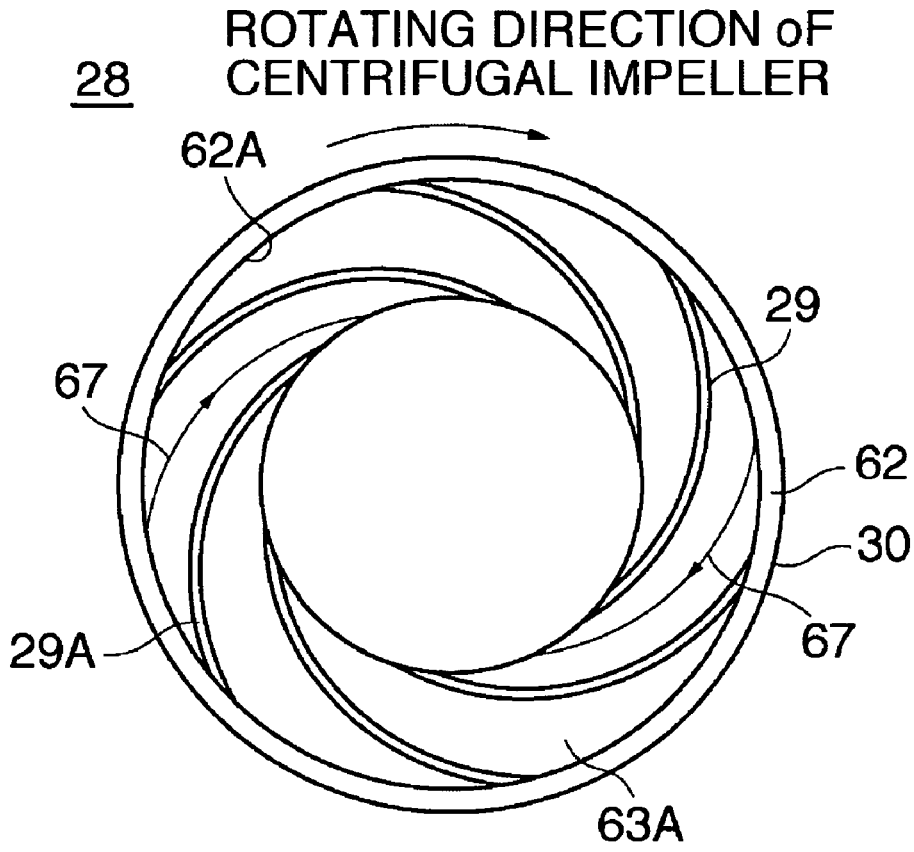
FIG. 6(*a*) is a plan view of a stationary impeller for a centrifugal impeller of the turbo vacuum pump shown in FIG. 1, and FIG. 6(*b*) is a cross-sectional front view of the stationary impeller.
Figure 6B:
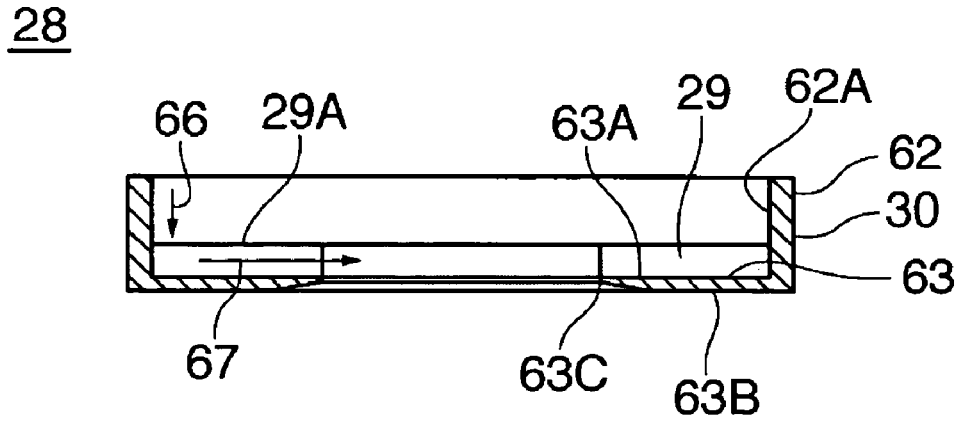

With reference to FIGS. 6(*a*) and 6(*b*), the configuration of the first stage stationary impeller 28 is described. FIG. 6(*a*) is a plan view of a stationary impeller 28, looking from the side of the suction nozzle 23A (FIG. 1). FIG. 6(*b*) is a cross-sectional front view of the stationary impellers 28. The stationary impeller 28 has a stationary impeller body 30 having an outer peripheral wall 62 and a side wall 63, and spiral guides 29 extending from a side 63A of the side wall 63 and having a convex cross-section. The rotating direction of the centrifugal impellers 24 (FIG. 1) is clockwise in FIG. 6(*a*).

As shown in FIG. 6(*a*), each of the stationary impellers 28 has a plurality of (six) spiral guides 29. The spiral guides 29 extend in such a direction as to cause the gas to flow in the direction of rotation (in the same direction as the direction of rotation). Each of the spiral guides 29 extends from an inner peripheral surface 62A of the outer peripheral wall 62 to an inner peripheral surface 63C of the side wall 63 of the stationary impeller 28. Each of the spiral guides 29 has a smooth end face 29A extending on a plane perpendicular to the central axis of the rotating shaft 21. A back side 63B of the stationary impeller 28, which is the side opposite the side on which the spiral guides 29 are formed, has a flat and smooth surface. Therefore, the back side 63B of the stationary impeller 28 directly facing the spiral vanes 26 of the corresponding centrifugal impeller 24 (FIG. 5) does not disturb the flow of gas flowing through flow passages between the spiral vanes 26 of the centrifugal impeller 24 extending in directions 65 (FIG. 5(*a*)). The second stage stationary impellers 28 (not shown in FIGS. 6(*a*) and 6(*b*)) is the same in configuration as the first stage stationary impellers 28. The number and shape of the spiral guides 29 may be changed as needed.

With reference to FIGS. 1 to 6 as needed, the operation of the turbo vacuum pump 1 is described.

When the first stage turbine impeller 70 rotates, gas is introduced in the axial direction in FIG. 1 through the suction nozzle 23A of the pump 1. The turbine impeller 70 increases the discharge rate and allows a relatively large amount of gas to be discharged. The introduced gas is decreased in speed and increased in pressure by the stationary impeller 71. The gas is then discharged in the axial direction by the second and third stage turbine impellers 70 and increased in pressure by the second and third stage stationary impellers 71 in the same manner.

Then, when the first stage centrifugal impeller 24 rotates, the gas is drawn in an axial direction. The gas drawn by the first stage centrifugal impeller 24 flows toward the outer periphery of the first stage centrifugal impeller 24 along the surface 27A of the base part 27 thereof and is compressed and discharged by a reciprocal action of the first stage centrifugal impeller 24 and the first stage stationary impeller 28, that is, by a drag effect caused by the viscosity of the gas and a centrifugal effect caused by the rotation of the centrifugal impeller 24.

That is, the gas drawn by the first stage centrifugal impeller 24 is introduced in a generally axial direction 64 shown in FIG. 5(*b*) relative to the centrifugal impeller 24, flows radially outward through passages 68 formed between the spiral vanes 26 of the first stage centrifugal impeller 24, and is compressed and discharged. At this time, the gas flows in the directions 65 shown in FIGS. 5(*a*) and 5(*b*), which is the direction relative to the first stage centrifugal impeller 24.

The gas compressed radially outward by the first stage centrifugal impeller 24 flows toward the first stage stationary impeller 28, is directed in a generally axial direction 66 shown in FIG. 6(*b*) by the inner peripheral surface 62A of the outer peripheral wall 62, and flows into a space having the spiral guides 29. Since the first stage centrifugal impeller 24 is rotating, the gas flows toward the inner periphery of the first stage stationary impeller 28 along the front side 63A of the side wall 63 thereof (the side of the side wall 63 on which the spiral guides 29 are attached) by a drag effect of the end faces 29A of the spiral guides 29 of the stationary impeller 28 and the back side 27B of the base part 27 of the first stage centrifugal impeller 24 caused by the viscosity of the gas, and is compressed and discharged. The gas having reached the inner periphery of the first stage stationary impeller 28 is directed in the generally axial direction 64 shown in FIG. 5(*b*) by the outer peripheral surface 61A of the boss part 61 of the first stage centrifugal impeller 24 and flows toward the second stage centrifugal impeller 24. Then, the gas is compressed and discharged in the same manner as described above, flows through the third stage centrifugal impeller 24, and is discharged through the discharge nozzle 23B. The suction pressure is in a low pressure range of 1 to 1000 Pa, and the discharge pressure is in a high pressure range of 100 Pa to atmospheric pressure.

The rotating impellers (the centrifugal impellers 24, and circumferential flow impellers 88, which are described later) may be secured to the outer periphery of the rotating shaft 21 by shrink-fit or loose fit. The advantages of loose fit are: (1) the centrifugal impellers 24 can be easily attached to the rotating shaft 21, and (2) any of the centrifugal impellers 24 can be removed even after all the centrifugal impellers 24 are attached to the rotating shaft 21. Therefore, only impellers with serious damage, deformation or corrosion can be replaced in an overhaul, for example. The advantage of shrink-fit is: (1) since the rigidity of the rotor is improved by the shrink-fit and the natural frequency of the entire rotor is increased, the capacity in controlling the rotational speed increases.

Figure 22:
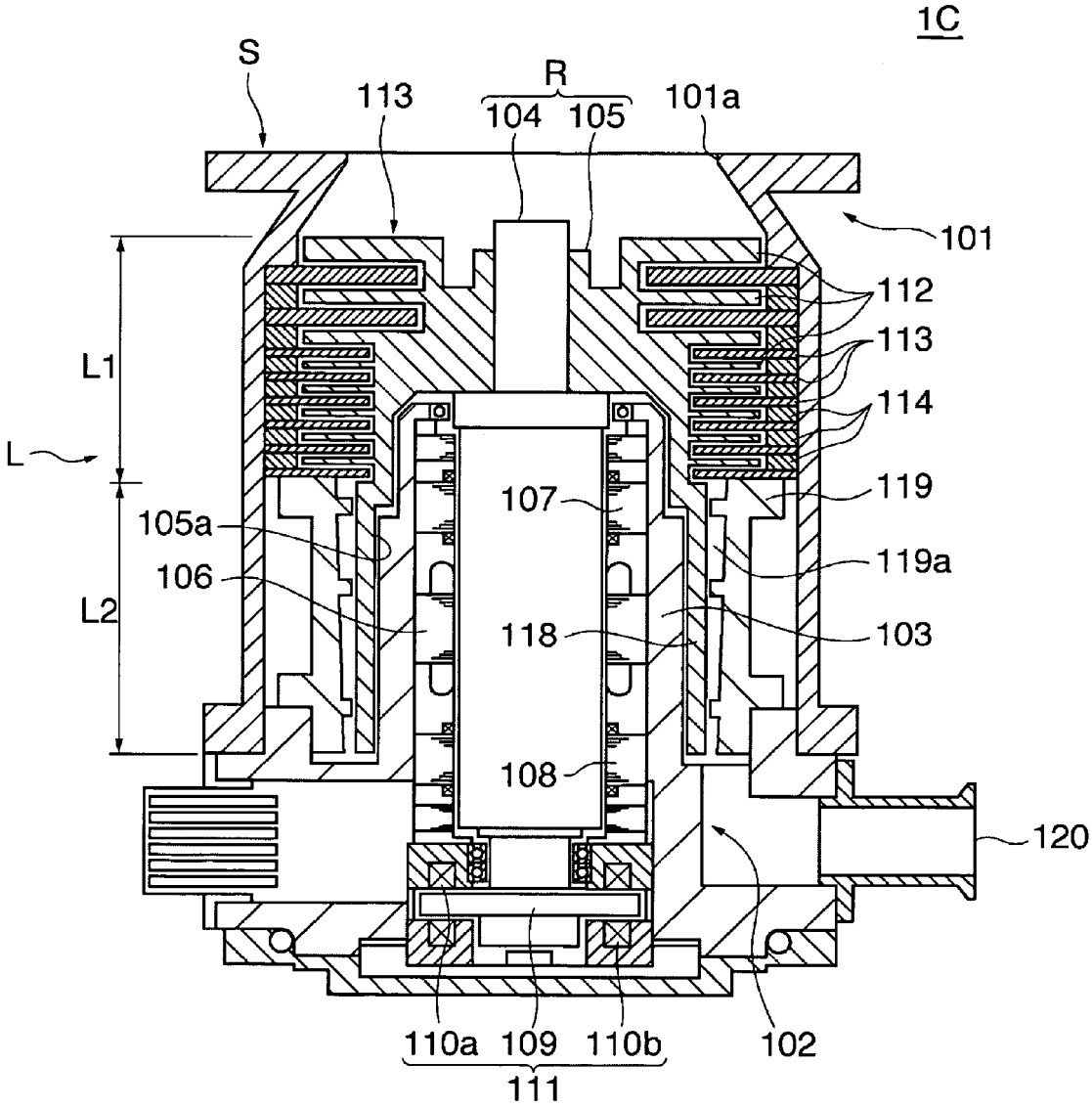
FIG. 22 PRIOR ART
FIG. 22 is a cross-sectional front elevation of a conventional turbo vacuum pump.

According to the pump 1 of this embodiment, the turbine impeller part 73 is made from a one-piece blank and secured to the suction part side end face 15 of the rotating shaft 21. That is, the pump 1 is different in structure from the conventional pump IC having a stator S housing a rotating shaft 104 and a rotor R having a hollow part 105*a*, in which the stator S is housed in the hollow part 105*a*, that is, the rotor R is arranged outside the stator S (FIG. 22). The rotational speed of the conventional pump IC is limited because of the centrifugal stress which is generated in the inner peripheral part of the hollow part 105*a*. In the pump 1 of this embodiment, however, the inside diameter of the through hole 58 of the turbine impeller part 73 has only to be large enough to receive the hexagonal bolt 78 and is smaller than the outside diameter of the rotating shaft 21. Also, the inside diameter of the hollow part 12 of the turbine impeller part 73 is slightly larger than the inside diameter of the through hole 58 and smaller than the outside diameter of the rotating shaft 21. Therefore, since the inside diameter of the through hole 58 and the inside diameter of the hollow part 12 can be both much smaller than the inside diameter of the hollow part 105*a* (FIG. 22), the centrifugal stress to be generated can be significantly decreased and high-speed rotation can be achieved.

Since the centrifugal impellers 24 are stacked on and attached to the rotating shaft 21 passing through the fitting holes 25 formed at the center thereof, the inside diameter of the fitting holes 25 can be much smaller than that of the hollow part 105*a* (FIG. 22). Therefore, the centrifugal stress to be generated in the inner peripheral part of the fitting holes 25 can be significantly decreased as in the case with the turbine impellers 70 and high-speed rotation can be achieved. Also, since this structure allows the gas to be drawn in an axial direction and flow radially outward through flow passages extending in the directions 65, the length of the flow passages can be significantly increased. Accordingly, the discharge performance, especially the compression performance, can be improved. In addition, since the stationary impellers 28 direct the gas radially inward through flow passages, that is, the gas to be discharged is caused to flow through long flow passages 67 and decreased in flow speed by the stationary impellers 28, the discharge performance and the compression performance can be improved.

Since the minimum outside diameter Dtmin of the turbine impellers 70 located on the suction part side from the suction part side end face 15 in the axial direction is greater than the maximum outside diameter Dgmax of the centrifugal impellers 24, the discharge performance of the turbine impeller 70 with the minimum outside diameter can be improved. Accordingly, the pump 1 can have high discharge performance. The ratio of the minimum outside diameter Dtmin of the turbine impellers 70 to the maximum outside diameter Dgmax of the centrifugal impellers 24 is preferably 1.2 or greater. Then, the discharge performance of the turbine impeller 70 having the minimum outside diameter can be further improved.

Since the centrifugal impellers 24 and the stationary impellers 28 have a multi-stacked structure, and since the spiral vanes 26 and the front side 27A of each centrifugal impeller 24, the spiral guides 29, the front side 63A, and the inner peripheral surface 62A of the outer peripheral wall 62 of each stationary impeller 28 are accessible from an axial direction, the centrifugal impellers 24 and the stationary impellers 28 can be machined easily and the production costs can be reduced.

Since the turbine impeller part 73 is attached to the suction part side end face 15 of the rotating shaft 21, the turbine impeller part 73, and the centrifugal impellers 24 as rotating impellers are formed separately. Therefore, when either the turbine impellers 70 or the centrifugal impellers 24 have damage, deformation or corrosion, only damaged, deformed or corroded parts can be replaced and there is no need to replace the entire rotor. Accordingly, the pump is advantageous for long term use. Also, since the centrifugal impellers 24 have a multi-stack structure and are formed independently, when any of the centrifugal impellers 24 has damage, deformation or corrosion, only the centrifugal impeller 24 with damage or the like can be replaced and there is no need to replace the entire rotor. Accordingly, the pump is advantageous for long term use.

Since the rotating impellers are separately formed as a plurality of separate elements as described above, the possibility of all the rotating impellers being broken at the same time is very small even if any of the rotating impellers is broken. Therefore, a large impact would not be applied to the casing of the pump, and the possibility of the casing of the pump being broken is small. Also, a large impact would not be applied to the peripheral devices directly or indirectly connected to the pump. Accordingly, the pump is safe.

The inside diameter of the through hole 58 of the turbine impeller part 73 is smaller than the outside diameter of the rotating shaft 21. Therefore, a large stress is not generated in the inner peripheral part of the through hole 58, and high-speed rotation can be achieved. The outside diameter of the rotating shaft 21 is preferably as large as possible as far as the stress of the inner peripheral parts of the centrifugal impellers 24 or circumferential flow impellers 88 (FIG. 10), which are described later, permit in order to increase the natural frequency of the entire rotor as much as possible. Since the turbine impeller part 73 is secured to the suction part side end face 15 of the rotating shaft 21, even if the natural frequency of the rotor may be decreased because of this structure, the outside diameter of the rotating shaft 21 is determined so that the natural frequency of the rotor is sufficiently far away from the operating rotational speed range. Therefore, the inside diameter of the through hole 58 formed to fix the turbine impeller part 73 to the suction side end face 15 of the rotating shaft 21 with the hexagonal bolt 78 can be smaller than the outside diameter of the rotating shaft 21.

Since the turbine impellers 70 which exhibit high discharge efficiency in a low-pressure range and the centrifugal impellers 24 which exhibit high discharge efficiency in a high-pressure range are combined as described above to construct the turbo vacuum pump 1, the discharge efficiency of the entire pump can be improved. Also, since the centrifugal impellers 24 discharge gas radially, the flow passage length can be increased without increasing the axial length of the pump. Accordingly, since the length of the part of the rotating shaft 21 on which the turbine impellers 70 and the centrifugal impellers 24 are mounted can be small, the natural frequency of the entire rotor is increased and high-speed rotation can be achieved easily.

According to the pump 1 of the first embodiment, the centrifugal impellers 24 are secured to the rotating shaft 21 extending through the centrifugal impellers 24. Therefore, the diameter of the boss parts 61 of the centrifugal impellers 24 can be small. Also, the centrifugal impellers 24 can produce flows in radial directions, the flow passage length can be increased and compression performance can be improved. Since the turbine impeller part 73 including the turbine impellers 70 is secured to the suction part side end face 15 of the rotating shaft 21, the diameter of the boss part 74 of the turbine impeller part 73 can be small. Therefore, the centrifugal force which is applied to the boss part 74 of the turbine impeller part 73 can be reduced, and high-speed rotation can be achieved. As a result, even when a large amount of gas is sucked, the suction pressure can be decreased due to the discharge effect of the turbine impellers and the gas can be compressed to a high pressure by the discharge effect of the centrifugal impellers 24. Further, this structure allows the turbine impeller part 73 and the centrifugal impellers 24 to be formed separately. Therefore, when any of the rotating impellers has damage, deformation or corrosion, only the damaged, deformed or corroded parts can be replaced and there is no need to replace all the rotating impellers. Accordingly, the pump 1 is advantageous for long term use.

Figure 7:
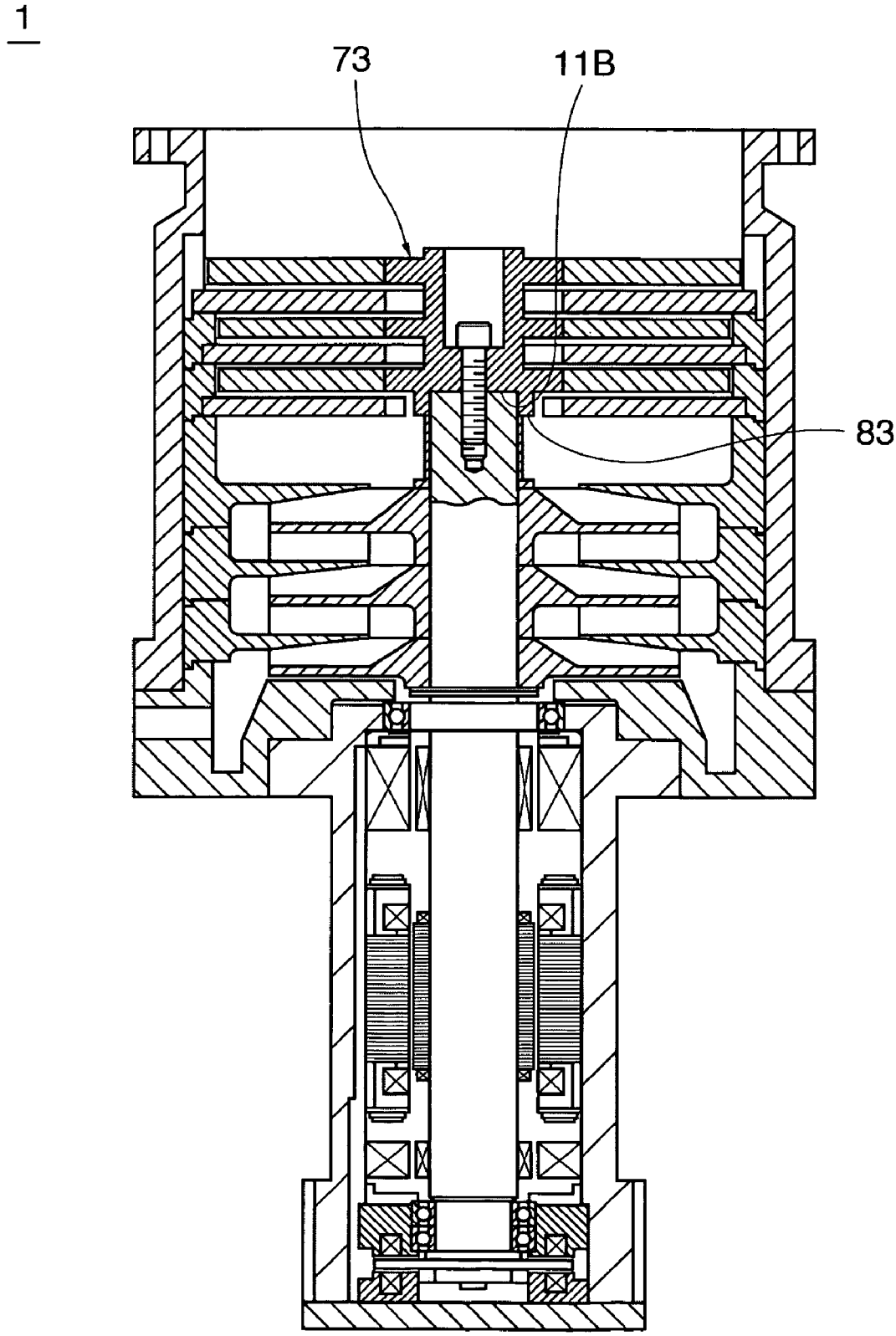
FIG. 7 is a view of the turbo vacuum pump shown in FIG. 1 in which an annular projection is formed on the discharge section side end face of the turbine impeller part.

As shown in FIG. 7, the turbine impeller part 73 of the pump 1 may have an annular projection 83 for receiving the rotating shaft 21 on the lower end face 11B (discharge section side end face). The inside diameter of the annular projection 83 is equal to the outside diameter of the rotating shaft 21. The annular projection 83 enables the turbine impeller part 73 to be easily positioned concentrically with the rotating shaft 21 and to be attached, without being tilted, with its axis coincident with the axis of the rotating shaft 21. Therefore, the turbine impeller part 73 can be prevented from increasing unbalance and can remain stable during high-speed rotation.

Figure 8:
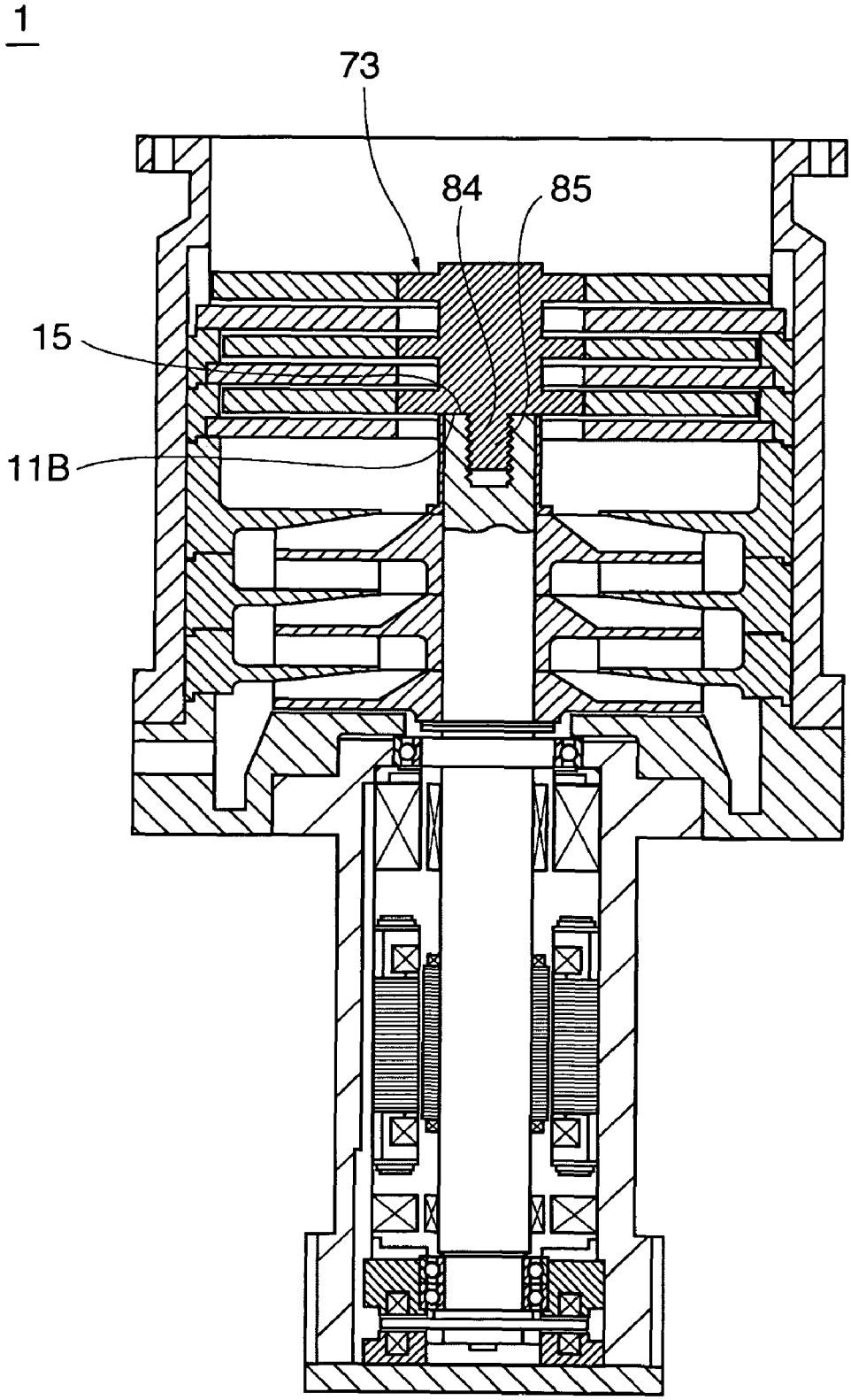
FIG. 8 is a view of the turbo vacuum pump shown in FIG. 1 in which a screw-like projection is formed on the discharge section side end face of the turbine impeller part.

As shown in FIG. 8, the turbine impeller part 73 of the pump 1 may have a projection 85 with external threads on the lower end face (discharge section side end face) 11B, and the rotating shaft 21 may have a cavity 84 with internal threads for threadedly receiving the projection 85 in the suction side end face 15. In this configuration, the turbine impeller part 73 can be solid and there is no need to form a through hole for attaching the turbine impeller part 73 to the suction side end face 15 of the rotating shaft 21. Therefore, the stress which is generated in the boss part 74 (FIG. 3) of the turbine impeller part 73 can be reduced and high-speed rotation can be achieved more reliably.

Figure 9:
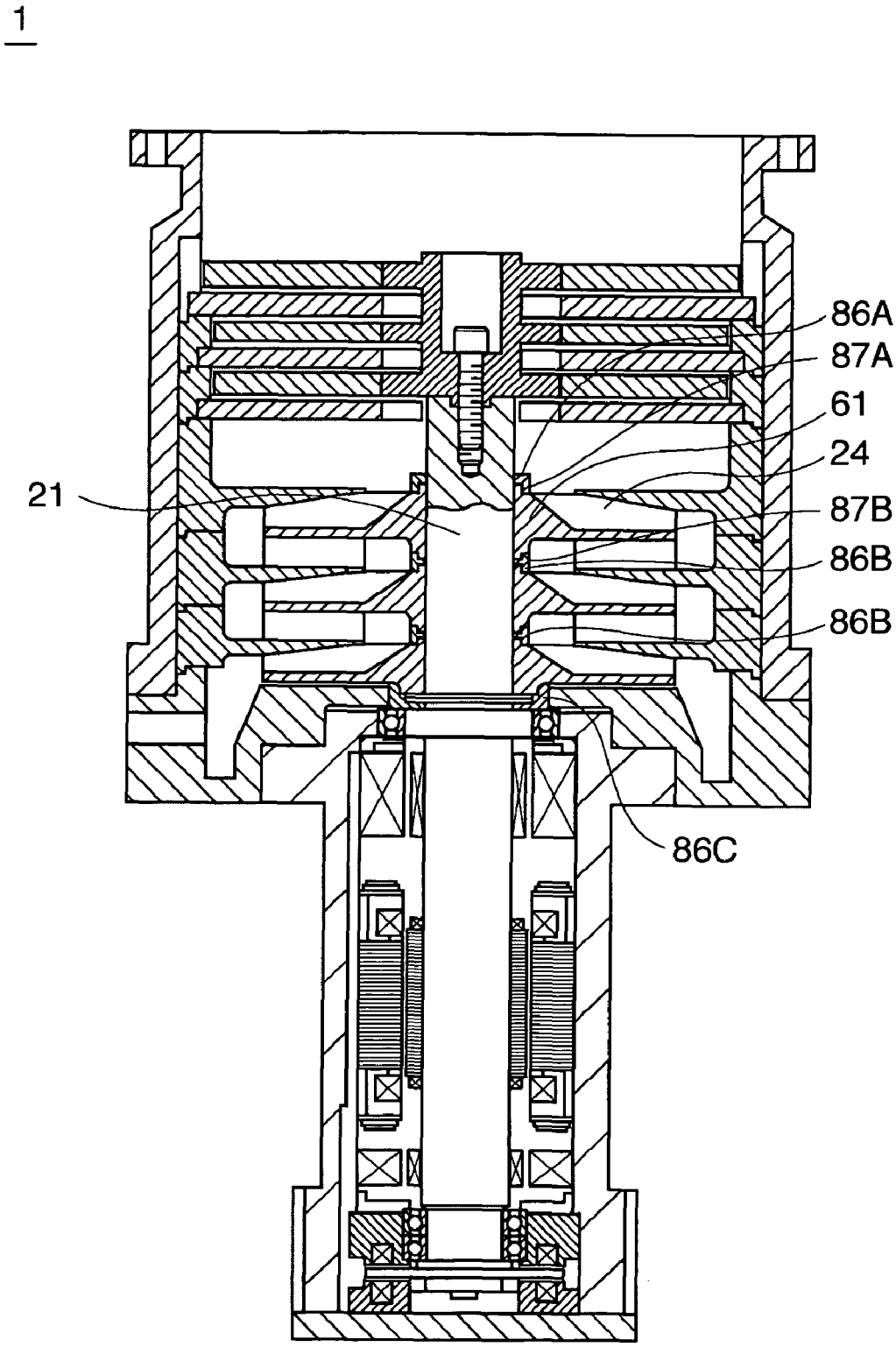
FIG. 9 is a view of the turbo vacuum pump shown in FIG. 1 in which retainer rings for pressing the centrifugal impellers are provided.

As shown in FIG. 9, the pump 1 may have retainer rings 86A, 86B and 86C for pressing the centrifugal impellers 24 radially inward. Each of the centrifugal impellers 24 has a front stepped part 87A on the suction part side of the boss part 61 (FIG. 5) and a rear stepped part 87B on the discharge section side of the boss part 61. The front stepped part 87A of the first stage centrifugal impeller 24 is pressed radially inward by the retainer ring 86A, the rear stepped part 87B of the first stage centrifugal impeller 24 and the front stepped part 87A of the second stage centrifugal impeller 24 by a retainer ring 86B, the rear stepped part 87B of the second stage centrifugal impeller 24 and the front stepped part 87A of the third stage centrifugal impeller 24 by another retainer ring 86B, and the rear stepped part 87B of the third stage centrifugal impeller 24 by the retainer ring 86C, and the intervals between the centrifugal impellers 24 are determined by the retainer rings 86B. In this configuration, since the centrifugal impellers 24 can be tightly secured to the rotating shaft 21, the rotor can be prevented from increasing unbalance quickly during high-speed rotation. Therefore, high-speed rotation can be achieved.

Figure 10:
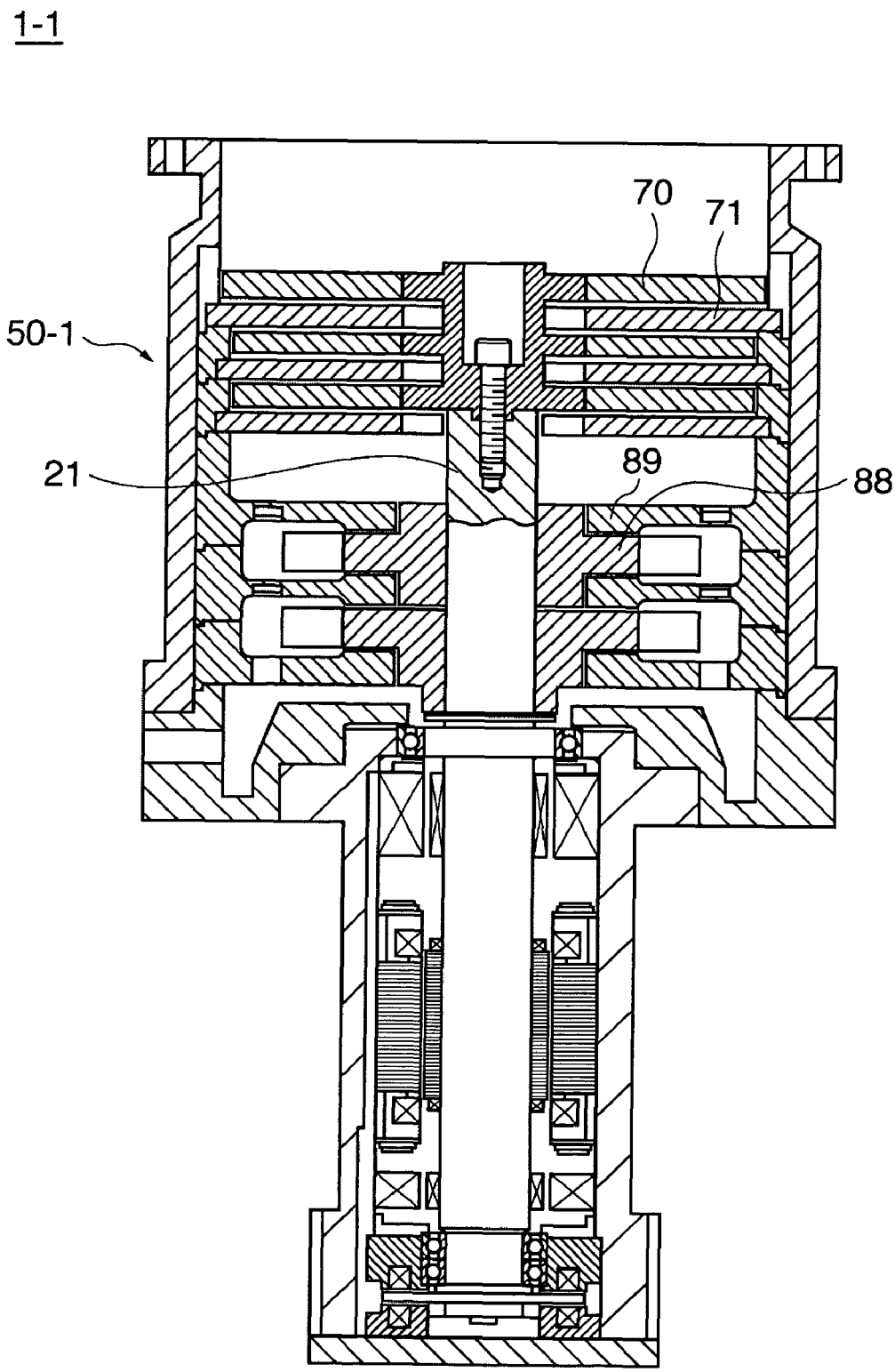
FIG. 10 is a cross-sectional front elevation of a turbo vacuum pump according to a second embodiment of the present invention.

FIG. 10 is a cross-sectional front elevation of a turbo vacuum pump 1-1, according to a second embodiment of the present invention, having two stages of circumferential flow impellers 88 instead of centrifugal impellers. The differences from the turbo vacuum pump 1 according to the first embodiment shown in FIG. 1 are hereinafter described.

A discharge section 50-1 includes a plurality of (three) stages of stationary impellers 71, a turbine impeller part 73 having a plurality of (three) stages of turbine impellers 70 as rotating impellers, and a plurality of (two) stages of circumferential flow impellers 88 as rotating impellers. The stationary impellers 71 are respectively located right downstream of the turbine impellers 70. Partitions 89 are provided upstream and downstream of the circumferential flow impellers 88.

Figure 11A:
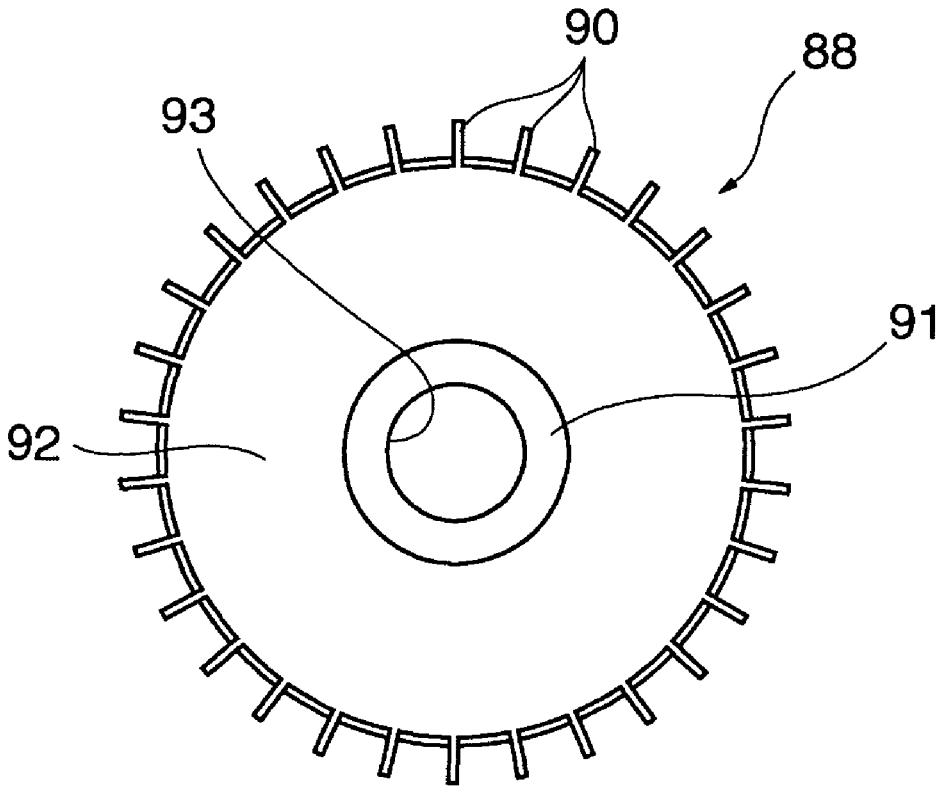
FIG. 11(*a*) is a plan view of a circumferential flow impeller of the turbo vacuum pump shown in FIG. 10, and FIG. 11(*b*) is a cross-sectional front view of the circumferential flow impeller.
Figure 11B:
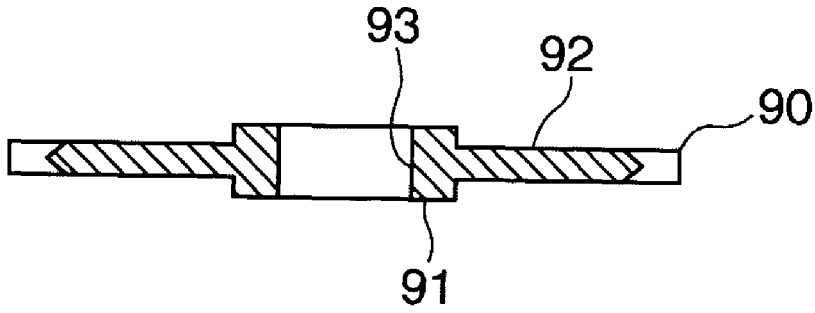

As shown in FIG. 11A, each of the circumferential flow impellers 88 has a boss part 91 with a shaft hole 93 for receiving the rotating shaft 21 (FIG. 10), a disk part 92 formed around the boss part 91, and vanes 90 extending radially from the outer periphery of the disk part 92. As illustrated in FIG. 11B, the axial width of each vane 90 is equal to the axial width of the disk part 92.

Figure 12:
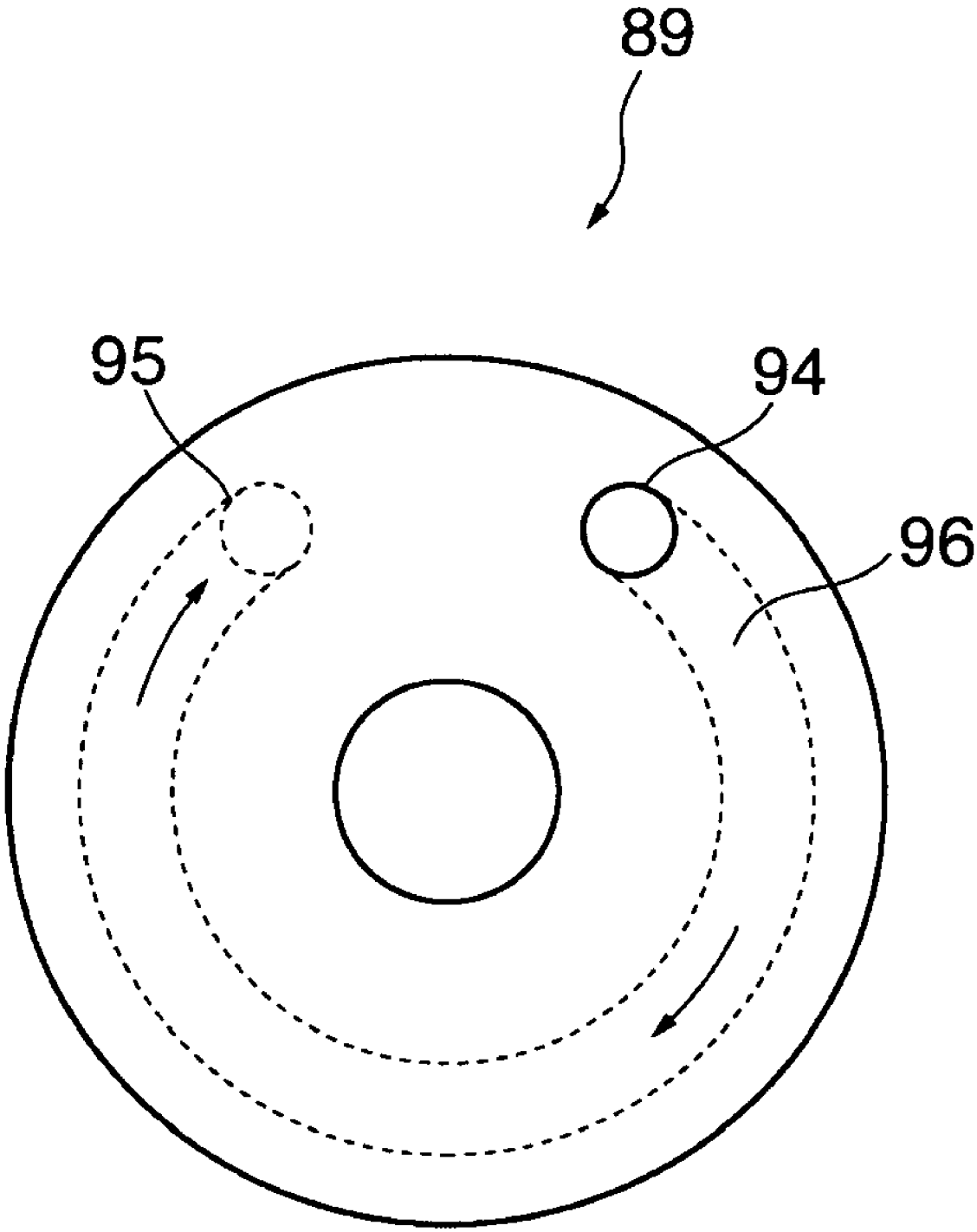
FIG. 12 is a partial plan view of a partition of the turbo vacuum pump shown in FIG. 10.

As shown in FIG. 12, each of the partitions 89 has a suction port 94 for introducing gas discharged by the circumferential flow impeller 88, a flow passage 96 formed in the partition 89 for directing the gas introduced through the suction port 94 in a circumferential direction, and a discharge port 95 for discharging the gas introduced into the flow passage 96 toward the circumferential flow impeller 88 on the downstream side.

Since the turbo vacuum pump 1-1 of this embodiment has the circumferential flow impellers 88, it has high discharge performance and can create a high back pressure.

Figure 13:
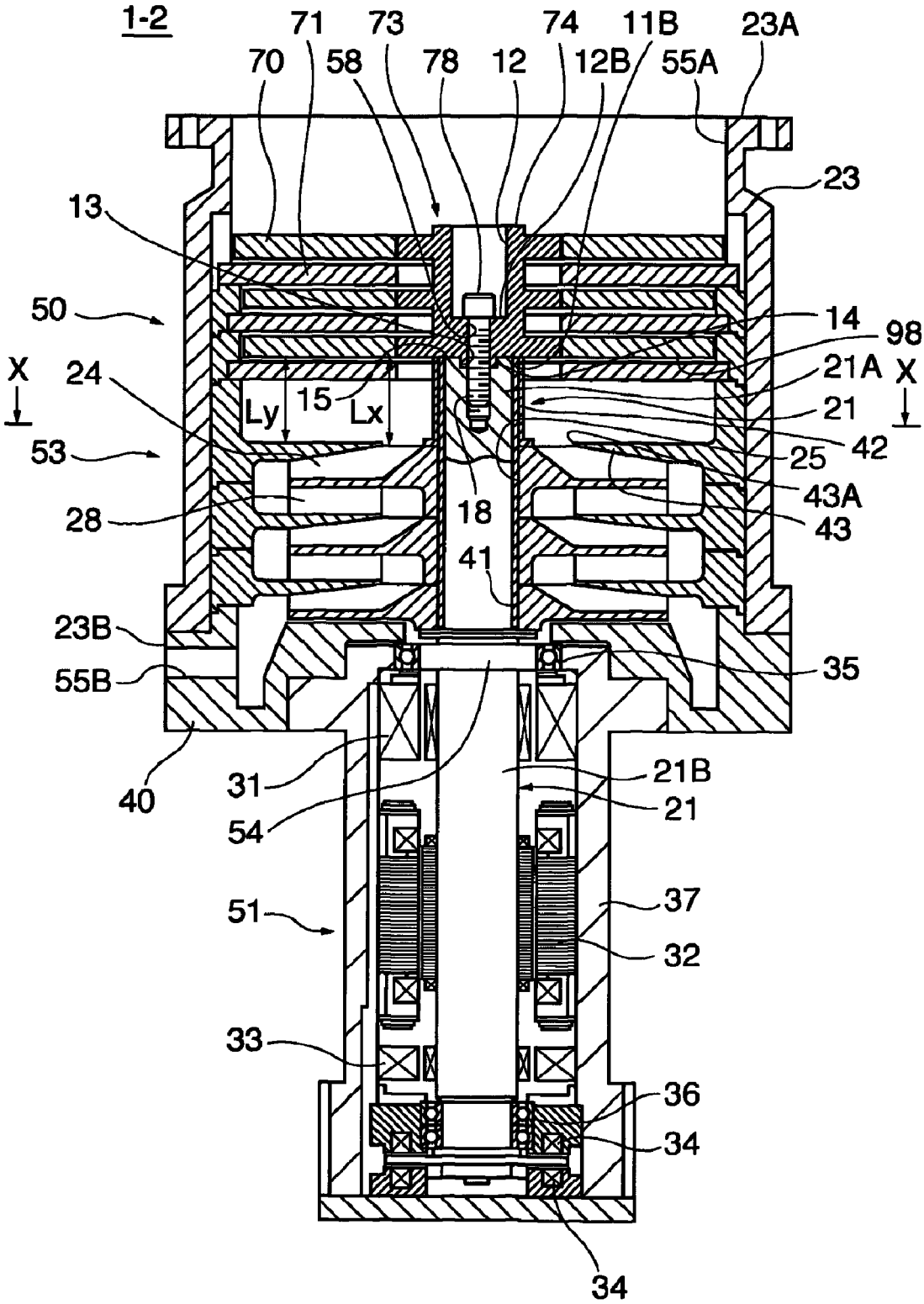
FIG. 13 is a cross-sectional front elevation of a turbo vacuum pump according to a third embodiment of the present invention.
Figure 14:
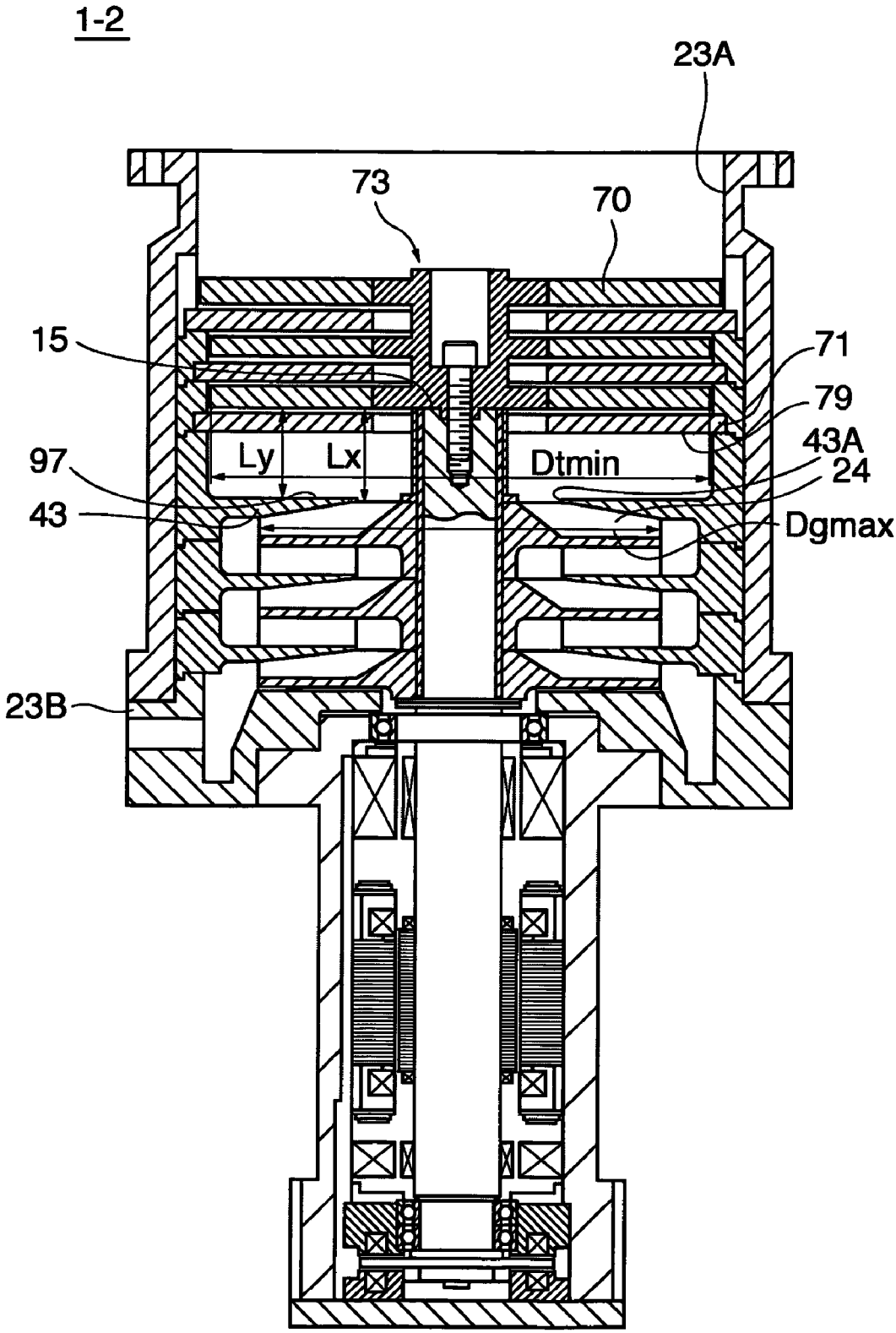
FIG. 14 is a view, describing the minimum outside diameter of turbine impeller and maximum outside diameter of centrifugal impeller in the turbo vacuum pump shown in FIG. 13.
Figure 15A:
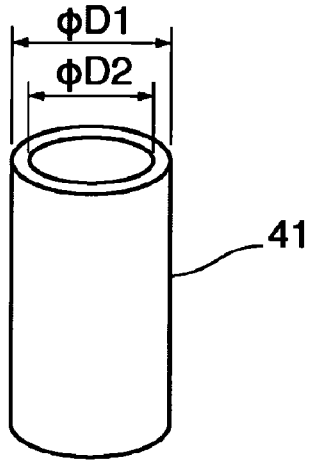
FIG. 15(*a*) is a perspective view of a round tubular ring, FIG. 15(*b*) is a partial perspective view of a rotating shaft, FIG. 15(*c*) is a partial perspective view of the rotating shaft on which the round tubular ring is shrink-fitted, and FIG. 15(*d*) is a partial perspective view of a rotating shaft on which a round tubular ring is not shrink-fitted.
Figure 15B:
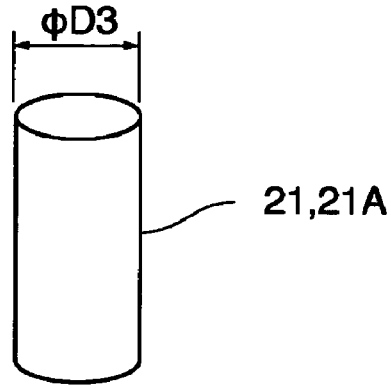
Figure 15C:
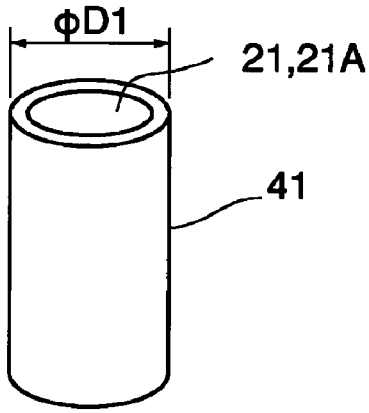
Figure 15D:
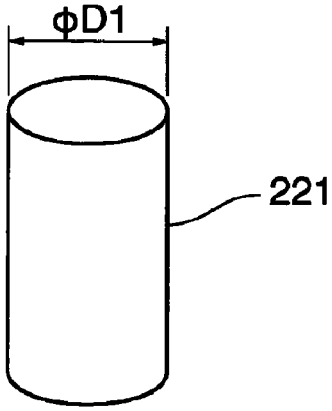

FIG. 13 is a cross-sectional front elevation of a turbo vacuum pump 1-2 according to a third embodiment of the present invention, and FIG. 14 is a view for explaining the minimum outside diameter of the turbine impellers and the maximum outside diameter of the centrifugal impellers of the turbo vacuum pump shown in FIG. 13. The differences from the turbo vacuum pump 1 according to the first embodiment (FIG. 1) are hereinafter described with reference to FIGS. 13 and 14.

A centrifugal partition 43 as a partition is located upstream of the first stage centrifugal impeller 24 of the discharge section 50, and the gas discharged from the turbine impellers 70 is drawn by the first stage centrifugal impeller 24 through an opening 43A of the centrifugal partition 43.

A stationary impeller 71 located right downstream of the last stage turbine impeller 70 has a flat discharge side end face 79 on its discharge side, and the centrifugal partition 43 has a flat suction side end face 97 on its suction side. A generally cylindrical hollow space is formed between the discharge side end face 79 and the suction side end face 97. The outside diameter of the space is generally equal to the outside diameter of the last stage turbine impeller 70.

The first stage centrifugal impellers 24 are located at an axial distance Lx from the last stage turbine impellers 70. That is, the axial distance between the discharge side end face 98 of the last stage turbine impeller 70 and a front end face 26A (FIG. 5(*b*)) of the first stage centrifugal impeller 24, which is described later, is Lx. The distance between the discharge side end face 98 of the last stage turbine impeller 70 and the suction side end face 97 of the centrifugal partition 43 is Ly.

A round tubular ring 41 with a round tubular shape is shrink-fitted on a discharge section side part 21A of the rotating shaft 21 on the side of the discharge section 50. Each of the centrifugal impellers 24 has a fitting hole 25 at its center. The rotating shaft 21, on which the round tubular ring 41 is shrink-fitted, passes through the fitting holes 25. The centrifugal impellers 24 are fixedly mounted on the rotating shaft 21 and stacked in layers. The round tubular ring 41 is located between the centrifugal impellers 24 and the rotating shaft 21 in the radial direction of the rotating shaft 21. The round tubular ring 41 extends in the axial direction of the rotating shaft 21 and covers the part of the rotating shaft 21 on which the three centrifugal impellers 24 are mounted, and also covers the part extending from the part of the rotating shaft 21 on which the three centrifugal impellers 24 are mounted to the suction part side end face 15. A shaft sleeve 42 is fitted on the outer periphery of the part of the round tubular ring 41 protruding from the centrifugal impellers 24.

FIG. 15(*a*) is a perspective view of the round tubular ring 41, FIG. 15(*b*) is a partial perspective view of the rotating shaft 21 (discharge section side part 21A of the rotating shaft 21 on the side of the discharge section 50 is shown), and FIG. 15(*c*) is a perspective view of the rotating shaft 21 shown in FIG. 15(*b*) on which the round tubular ring 41 is shrink-fitted. FIG. 15(*d*) is a partial perspective view of a rotating shaft 221 in the case where the round tubular ring 41 is regarded as being integrated with the rotating shaft 21, showing the part corresponding to the part of the rotating shaft 21 shown in FIG. 15(*b*). The round tubular ring 41 has an outside diameter D1 and an inside diameter D2. The rotating shaft 21 has an outside diameter D3. The outside diameter of the rotating shaft 221 is D1. Since the round tubular ring 41 is shrink-fitted on the rotating shaft 21, D3 is greater than D2. The outside diameter of the round tubular ring 41 shrink-fitted on the rotating shaft 21 is D1. The parts of the rotating shaft 21, the round tubular ring 41 and the rotating shaft 221 shown in the drawing have the same length. The only difference between the rotating shaft 21 and the rotating shaft 221 is whether the round tubular ring is shrink-fitted on the shaft or integrated with the shaft, and the same turbine impellers and centrifugal impellers can be mounted on the rotating shaft 21 and the rotating shaft 221.

Referring again to FIGS. 13 and 14, a description is made. As described before, the round tubular ring 41 is shrink-fitted on the part of the rotating shaft 21 which fixedly passes through the centrifugal impellers 24 in the pump 1-2 of this embodiment. Since the round tubular ring 41 is shrink-fitted on the rotating shaft 21, internal stress is applied to the rotating shaft 21 and the round tubular ring 41, and the bending rigidity (which is hereinafter referred to as "rigidity") and the natural frequency of the entire rotating shaft 21 including the round tubular ring 41 are increased. When the constitution of this embodiment is employed, the natural frequency of the rotating shaft 21 with an outside diameter D3 on which the round tubular ring 41 with an outside diameter D1 (D3 <D1) is shrink-fitted is higher than that of the rotating shaft 221 with an outside diameter D1 in which the shaft is integrated with the round tubular ring 41. Therefore, (1) since the outside diameter of the part of the rotating shaft 21 on which the round tubular ring 41 is shrink-fitted and to which the centrifugal impellers 24 are secured is D1, which is the same as the outside diameter of the rotating shaft 221 (FIG. 15) integrated with the round tubular ring 41, the same stress is applied to the centrifugal impellers 24 under the same rotational speed, and (2) since the rigidity of the entire rotating shaft 21 on which the round tubular ring 41 is shrink-fitted is increased, the axial length of the rotating shaft 21 can be extended so that the axial distance between the last stage turbine impeller 70 and the first stage centrifugal impeller 24 can be sufficiently large to improve the discharge performance of the turbine impellers 70.

When the outside diameter D3 of the rotating shaft 21 and the inside diameter D2 of the round tubular ring 41 are too small relative to the outside diameter D1 of the round tubular ring 41 to be shrink-fitted on the rotating shaft 21, the effect of the round tubular ring 41 applied to the rotating shaft 21 as a load mass (mass, moment of inertia) will be greater than the effect of the improvement of internal stress created by the shrink fit of the round tubular ring 41. As a result, the rigidity of the entire rotating shaft including the round tubular ring 41 and the rotating shaft 21 cannot be improved.

When the ratio D3/D1 is increased, the outside diameter D3 of the rotating shaft 21 and the inside diameter D2 of the round tubular ring 41 can be large. Then, the effect of the round tubular ring 41 as a load mass (mass, moment of inertia) can be decreased but the thickness of the round tubular ring 41 for shrink fit is decreased. When the thickness of the round tubular ring 41 is too small, the internal stress which is applied to the inner peripheral part of the round tubular ring 41 when the round tubular ring 41 rotates may exceed tolerance limits and cause breakage of the round tubular ring 41.

The optimum value of the ratio D3/D1 of the outside diameter of the rotating shaft 21 to the outside diameter of the round tubular ring 41 is determined based on the materials of the rotating shaft 21 and the round tubular ring 41, the shrinkage allowance for shrink fit and so on. According to a result of calculation, the ratio D3/D1 of the outside diameter of the rotating shaft 21 to the outside diameter of the round tubular ring 41 to be shrink-fitted is preferably 75% or higher. The maximum value of the ratio D3/D1 is determined so that the round tubular ring 41 cannot be broken based on the outside diameters and the materials of the round tubular ring 41 and the rotating shaft 21, the allowance for shrink fit, the rotational speed and so on.

Since the rotating shaft is divided into the round tubular ring 41 and the rotating shaft 21, the round tubular ring 41 may be made of a material with a high Young's modulus different from that for the rotating shaft 21. The rotating shaft 21 is generally made of a martensitic stainless steel with a Young's modulus of about 200 GPa. When a steel with a high Young's modulus (250 GPa or higher) composite with titanium boride particles is used as the material for the round tubular ring 41, the rigidity of the entire shaft and the natural frequency of the rotor can be further improved.

Figure 16:
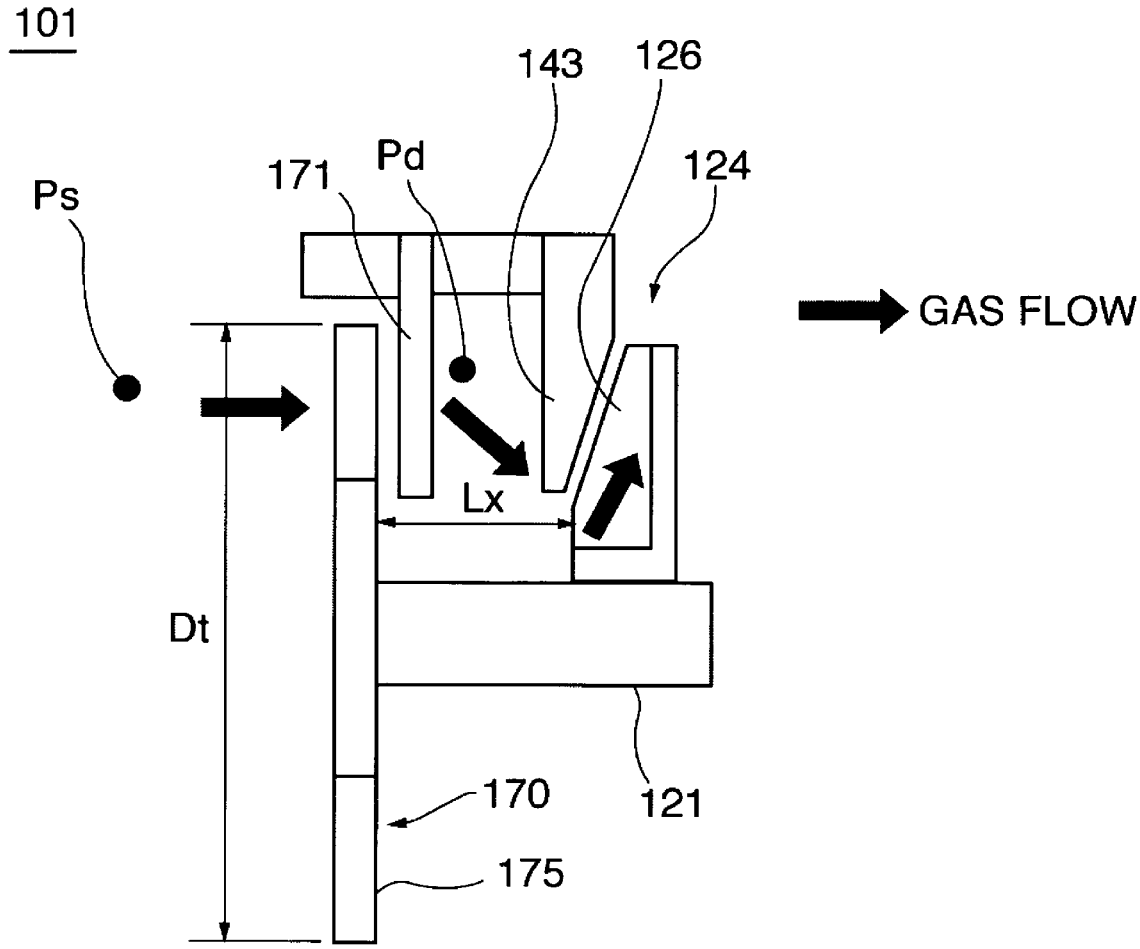
FIG. 16 is a partial schematic cross-sectional view, illustrating a turbo vacuum pump having a rotating shaft on which a single turbine impeller and a single centrifugal impeller are mounted.

FIG. 16 is a partial schematic cross-sectional view illustrating a turbo vacuum pump 101 having a rotating shaft 121 on which a single stage turbine impeller 170 (having a structure identical with that of the turbine impeller 70 shown in FIG. 3) and a single stage centrifugal impeller 124 (having a structure identical with that of the centrifugal impeller 24 shown in FIG. 5) are mounted. A turbine stationary impeller 171 (having a structure identical with that of the turbine stationary impeller 71 shown in FIG. 4) is located downstream of the turbine impeller 170. The turbine impeller 170 has vanes 175, and has an outside diameter Dt. The centrifugal impeller 124 has spiral vanes 126. The turbine impeller 170 and the centrifugal impeller 124 are axially spaced apart from each other by a distance Lx. The axial distance Lx between the turbine impeller 170 and the centrifugal impeller 124 is the axial distance from the downstream side end faces of the base parts of the vanes 175 of the turbine impeller 170 to the front end faces of the base parts of the spiral vanes 126 of the centrifugal impeller 124 (as measured parallel to the center line of the rotating shaft 121). The turbine impeller 170 shown in the drawing corresponds to the last stage turbine impeller 70 shown in FIG. 13, and the centrifugal impeller 124 shown in the drawing corresponds to the first stage centrifugal impeller 24 shown in FIG. 13. In the turbo vacuum pump 101, the pressure Ps on the suction side of the turbine impeller 170 and the pressure Pd on the discharge side of the turbine impeller 170 can be measured (the unit is Torr).

Figure 17:
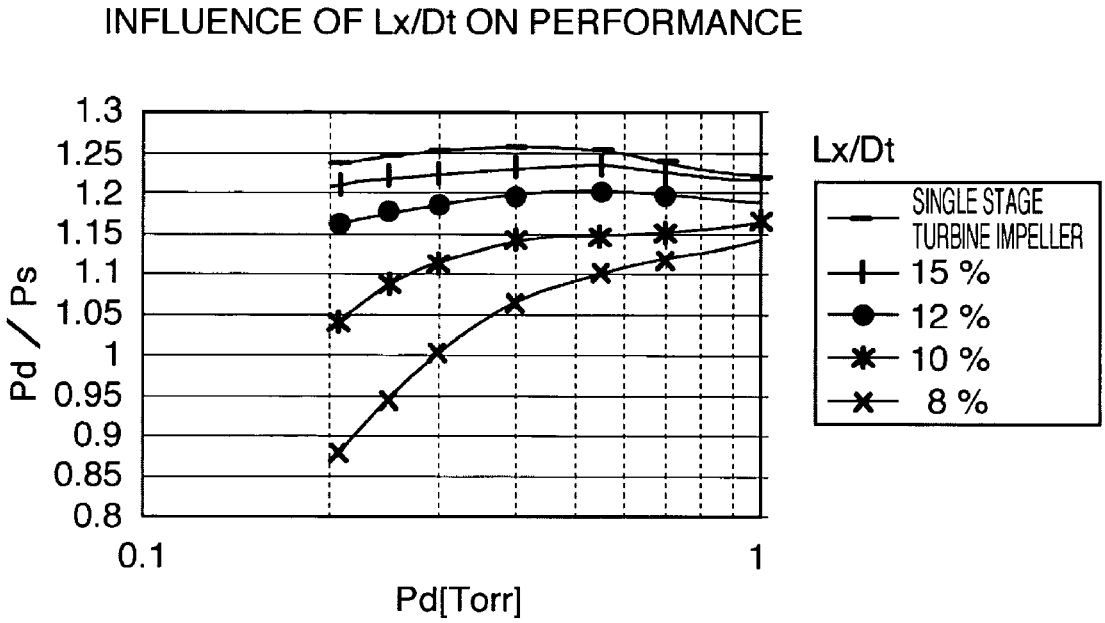
FIG. 17 is a performance graph of the turbo vacuum pump shown in FIG. 16.

FIG. 17 is a performance graph showing the result of an experiment conducted on the turbo vacuum pump 101 (FIG. 16) with a single turbine impeller in which the distance Lx is variable and a centrifugal partition 143 is located downstream of the turbine impeller using Lx/Dt (FIG. 16) as a parameter (8, 10, 12 and 15%) to study the influence of the centrifugal partition 143 on the turbine impeller performance (including the case where only the turbine impeller 170 is provided). The horizontal axis represents the pressure Pd on the discharge side of the turbine impeller 170, and the vertical axis represents Pd/Ps. When the centrifugal impeller 124 is moved closer to the turbine impeller 170 to reduce the axial distance Lx, the gas discharged by the turbine impeller 170 collides with the centrifugal partition 143 upstream of the centrifugal impellers 124 and is not smoothly drawn by the centrifugal impellers 124. A value Pd/Ps of 1 or smaller in the performance graph indicates that some of the gas flows in a reverse direction toward the turbine impeller 170. As the axial distance Lx is increased, the influence of the centrifugal partition 143 decreases, and the flowing direction of the gas discharged by the turbine impeller 170 and flowing axially can be changed more smoothly toward the suction side of the centrifugal impeller 124 while the gas is flowing through the space between the turbine impeller 170 and the centrifugal impellers 124 (along axial distance). Then, the gas is drawn by the centrifugal impeller 124 more smoothly, and the performance of the turbine impeller 170 becomes closer to the original performance of a single stage turbine impeller.

When the rigidity of the rotating shaft is improved to increase the natural frequency thereof, the distance Lx between the turbine impeller 170 and the centrifugal impeller 124 can be large to increase the length of the rotating shaft 121.

The following results are obtained from the performance graph shown in the drawing. When Lx/Dt is approximately 15% or greater, in the turbo vacuum pump 1-2 shown in FIG. 13, when the axial distance Lx between the last stage impeller 70 and the first stage centrifugal impeller 24 is approximately 15% of the outside diameter of the last stage turbine impeller 70, performance close to that which can be achieved when a single turbine impeller 70 is provided can be obtained and the influence of the centrifugal partition 43 is hardly noticeable. The greater the axial distance Lx, the better. In view of the limitations on the dimensions of the pump and the natural frequency of the entire rotor of the pump which can ensure stable control of the magnetic bearings, Lx/Dt is preferably at least 12%. In this case, since Lx is almost equal to Ly in this embodiment, Ly/Dt is approximately 12% or greater. Also, the axial distance between the stationary impeller 71 right downstream of the last stage turbine impeller 70 and the centrifugal partition 43 is 9% or greater of the outside diameter of the last stage turbine impeller 70. In this embodiment, the total of the axial width of the stationary impeller 71 and the distance between the stationary impeller 71 and the last stage turbine impeller 70 is equivalent to 3% of the outside diameter of the last stage turbine impeller 70.

The operation of the turbo molecular pump 1-2 is described by providing additional explanation to the explanation of the operation of the turbo vacuum pump 1 (FIG. 1).

In the pump 1-2 of this embodiment in which the turbine impellers 70 and the centrifugal impellers 24 are secured to the rotating shaft 21 in series in the axial direction, when the axial distance Lx between the last stage turbine impeller 70 and the first stage centrifugal impeller 24 is too small (narrow), the performance of the last stage turbine impeller 70 is deteriorated. The reasons for it will be explained in the following. A disk-shaped centrifugal partition 43 is located upstream of the rotatable first stage centrifugal impeller 24 with a small axial clearance therebetween. The centrifugal partition 43 has an opening 43A. The gas discharged by the last stage turbine impeller 70 passes through opening 43A, is drawn through the inner peripheral side of the first stage centrifugal impeller 24 and is compressed radially outward by a centrifugal force and a drag effect. At this time, when the axial distance Lx between the turbine impeller 70 and the centrifugal impeller 24 is small, the gas discharged by the turbine impeller 70 collides with the centrifugal partition 43 and is not smoothly introduced toward the inner peripheral part of the centrifugal impeller 24 or flows in reverse toward the turbine impeller 70.

To increase the axial distance Lx to solve the problem, the axial length of the rotating shaft 21 must be increased. Then, however, the natural frequency of the rotor is decreased and the magnetic bearings 31, 33 and 34 cannot ensure stable rotation. To increase the axial length of the rotating shaft 21 and increase the natural frequency of the rotor, the outside diameter of the rotating shaft 21 needs to be increased to increase the thickness thereof. However, since the centrifugal impellers 24 are secured to the rotating shaft 21 extending therethrough, when the outside diameter of the rotating shaft 21 is increased, the inside diameter of the parts of the centrifugal impellers 24 through which the rotating shaft 21 extends is increased, which causes an increase of internal stress in the inner peripheral parts of the centrifugal impellers 24 and hinders high-speed rotation.

In this embodiment, since the round tubular ring 41 is shrink-fitted (tightly fitted) on the rotating shaft 21, the axial length Lx can be increased without increasing the outside diameter of the rotating shaft 21 (the inside diameter of the parts of the centrifugal impellers 24 through which the rotating shaft 21 extends) as described before. Therefore, the gas can flow smoothly between the last stage turbine impeller 70 and the first stage centrifugal impeller 24, and the natural frequency of the rotor can be increased to achieve high-speed rotation. As a result, there can be provided a turbo vacuum pump 1-2 which exhibits high pump discharge performance.

Turbo vacuum pumps 1-2 according to other embodiments will now be described.

Figure 18:
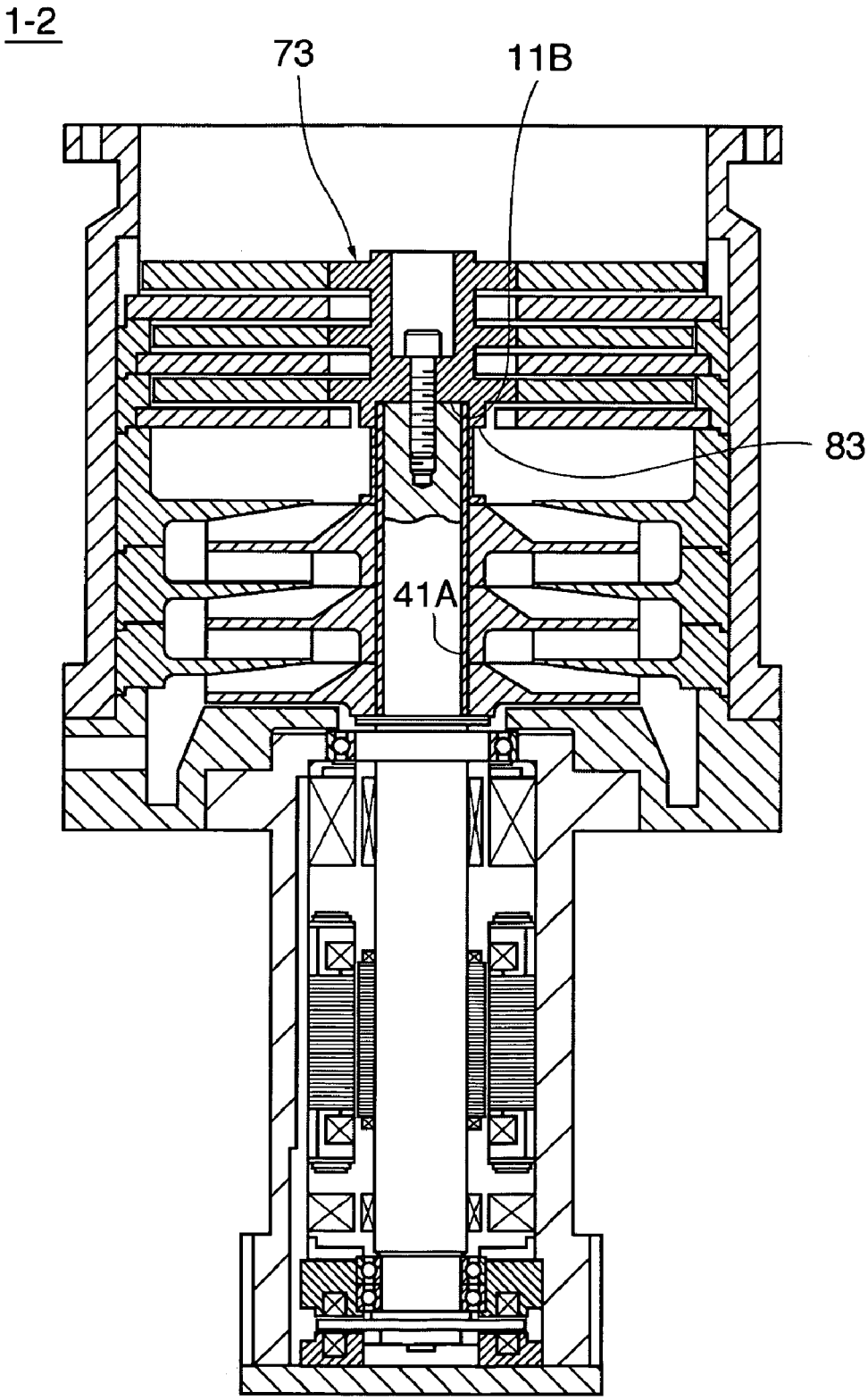
FIG. 18 is a view of the turbo vacuum pump shown in FIG. 13 in which an annular projection is formed on the discharge section side end face of the turbine impeller part

FIG. 18 is a view of a turbo vacuum pump 1-2 shown in FIG. 13, in which an annular projection 83 is formed on the discharge section side end face of the turbine impeller part 73.

Figure 19:
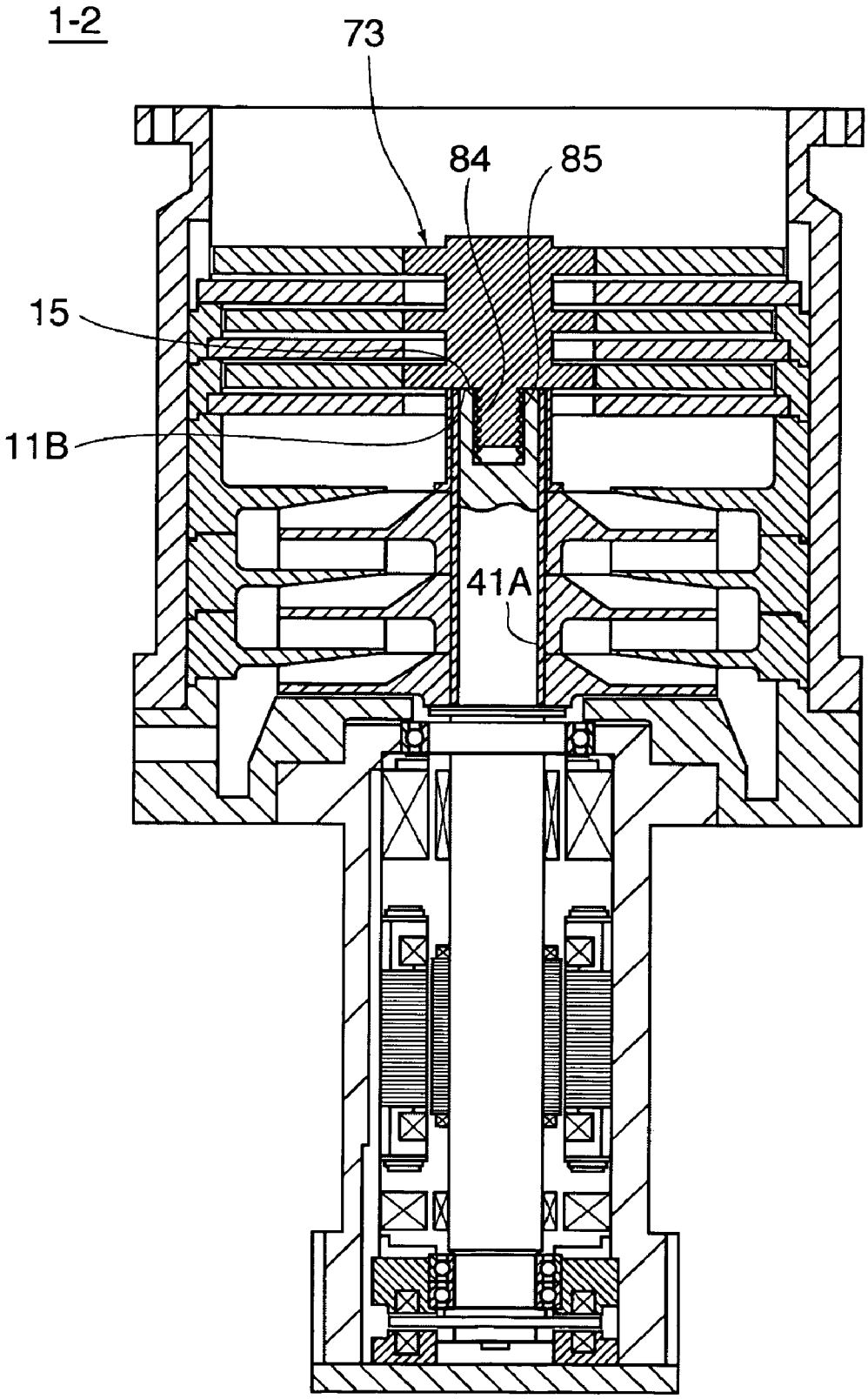
FIG. 19 is a view of the turbo vacuum pump shown in FIG. 13 in which a screw-like projection is formed on the discharge section side end face of the turbine impeller part

FIG. 19 is a view of a turbo vacuum pump 1-2 shown in FIG. 13, in which a screw-like projection 85 is formed on the discharge section side end face of the turbine impeller part 73.

Figure 20:
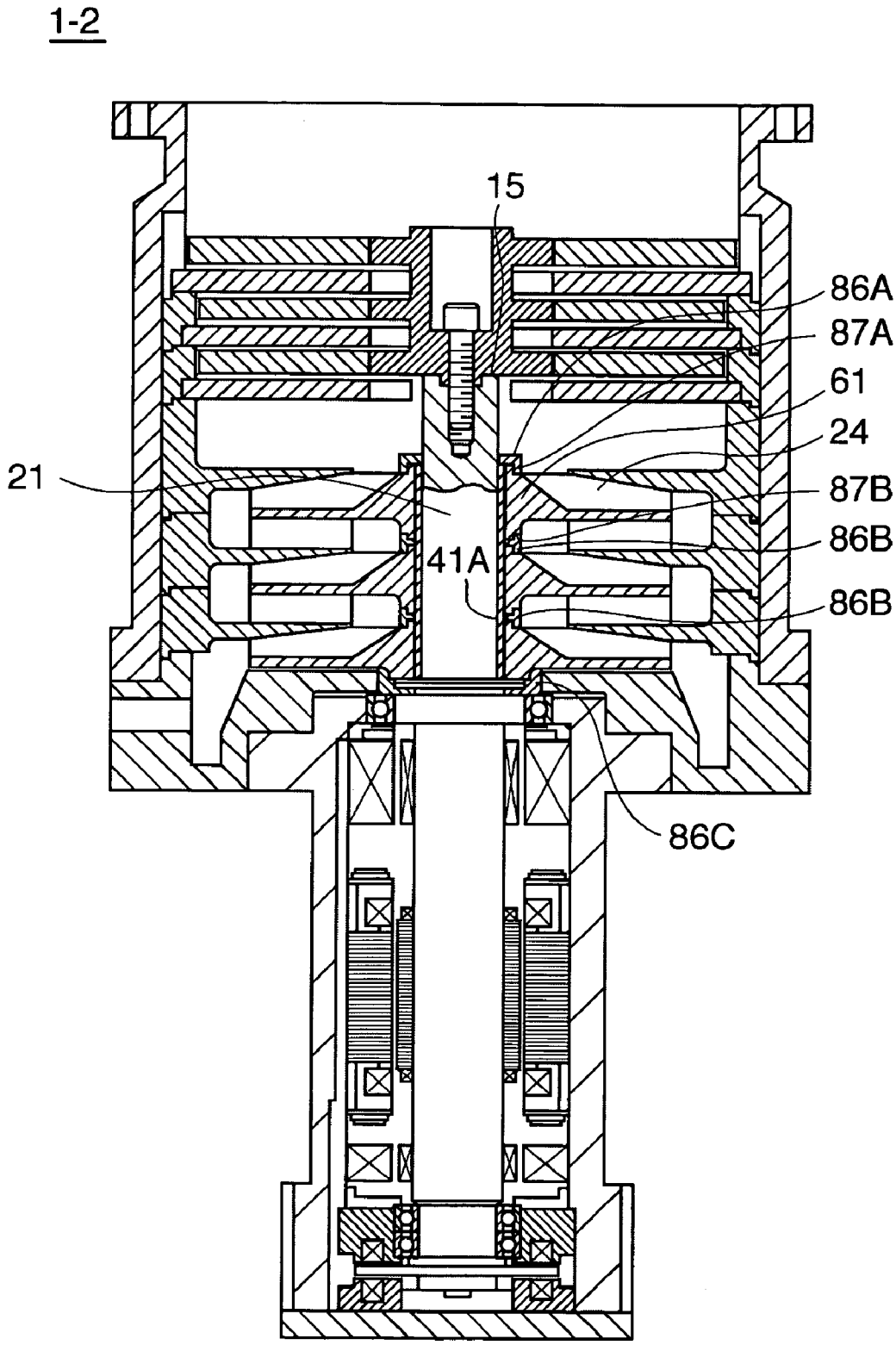
FIG. 20 is a view of the turbo vacuum pump shown in FIG. 13 in which retainer rings for pressing the centrifugal impellers are provided.

FIG. 20 is a view of a turbo vacuum pump 1-2, shown in FIG. 13, having a retainer ring 86 for pressing the centrifugal impellers 24.

The turbo vacuum pumps 1-2 shown in FIGS. 18, 19 and 20 are the turbo vacuum pumps 1 shown in FIGS. 7, 8 and 9, respectively, in which a round tubular ring 41A is shrink-fitted (tightly fitted) on the discharge section side part 21A of the rotating shaft 21 on the side of the discharge section 50. By shrink fitting a round tubular ring 41A as described above, effects which are the same as those of the turbo vacuum pump 1-2 according to the third embodiment can be obtained in the turbo vacuum pumps 1 shown in FIGS. 7, 8 and 9.

In the turbo vacuum pumps 1-2 shown in FIG. 20, the round tubular ring 41A shrink-fitted on the rotating shaft 21 may not necessarily extend to the suction part side end face 15 at the upper end of the rotating shaft 21. When the round tubular ring 41A is shrink-fitted on the part of the rotating shaft 21 on which the three stage centrifugal impellers 24 are mounted (the part where deflection is generated by rotation), it may not cover the part of the rotating shaft 21 protruding from the centrifugal impellers 24. In this configuration, the rigidity of the rotating shaft (the rotating shaft 21 and the round tubular ring 41A) can be improved with a round tubular ring 41A having a short length.

Figure 21:
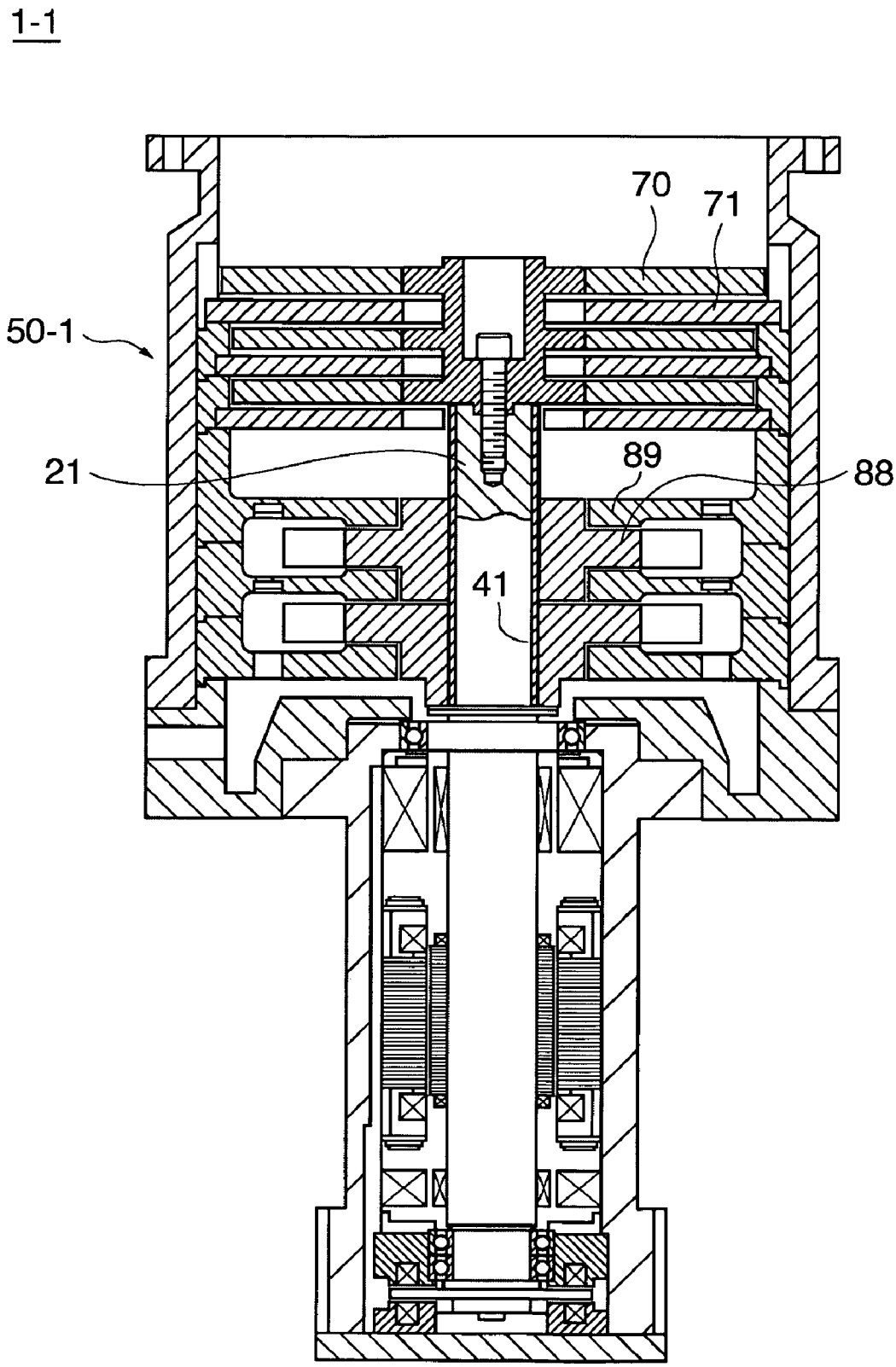
FIG. 21 is a cross-sectional front elevation of a turbo vacuum pump according to another embodiment of the present invention.

In the turbo vacuum pump 1-1 shown in FIG. 10, a round tubular ring 41 having a round tubular shape may be shrink-fitted (tightly fitted) on the discharge section side part 21A of the rotating shaft 21 on the side of the discharge section 50 as in the turbo vacuum pump 1-1 shown in FIG. 21. By shrink-fitting a round tubular ring 41 as described above, the same effects as those of the turbo vacuum pump 1-2 according to the third embodiment can be obtained.

The use of the terms "a" and "an" and "the" and similar terms in the context of describing the invention (especially in the context of the following claims) are to be construed to cover both the singular and the plural, unless otherwise indicated herein or clearly contradicted by context. The use of any and all examples, or exemplary language (e.g., "such as") provided herein, is intended merely to better illuminate the invention and does not pose a limitation on the scope of the invention unless otherwise claimed.

What is claimed is:

1. A turbo vacuum pump, comprising:

a suction part for sucking gas in an axial direction;

a discharge section in which rotating impellers and stationary impellers are alternately arranged;

a rotating shaft for rotating said rotating impellers; and a turbine impeller part fixed to a suction side axial end face of said rotating shaft;

wherein said rotating impellers include one or more turbine impellers for discharging the sucked gas in said axial direction, and one or more centrifugal impellers, located downstream of said one or more turbine impellers, for further discharging the discharged gas by a centrifugal drag effect, wherein said turbine impeller part and said one or more centrifugal impellers are separately formed, wherein said one or more turbine impellers are included in said turbine impeller part, and wherein at least one stage of said one or more centrifugal impellers is a circumferential flow impeller having a disk part and a vane extending radially from an outer periphery of said disk part, an axial width of said vane being equal to an axial width of said disk part.

2. The turbo vacuum pump according to claim 1, wherein said turbine impeller part is integrally formed.

3. A turbo vacuum pump, comprising:

a suction part for sucking gas in an axial direction;

a discharge section in which rotating impellers and stationary impellers are alternately arranged;

a rotating shaft for rotating said rotating impellers; and a turbine impeller part fixed to a suction side axial end face of said rotating shaft;

wherein said rotating impellers include one or more turbine impellers for discharging the sucked gas in said axial direction, and one or more centrifugal impellers, located downstream of said one or more turbine impellers, for further discharging the discharged gas by a centrifugal drag effect, wherein said turbine impeller part and said one or more centrifugal impellers are separately formed, wherein said one or more turbine impellers are included in said turbine impeller part, and wherein the last stage of said one or more turbine impellers is located on the suction side of said suction side axial distal end face of said rotating shaft in said axial direction.

4. The turbo vacuum pump according to claim 3, wherein said turbine impeller part is integrally formed.

5. A turbo vacuum pump, comprising:

a suction part for sucking gas in an axial direction;

a discharge section in which rotating impellers and stationary impellers are alternately arranged;

a rotating shaft for rotating said rotating impellers; and a turbine impeller part fixed to a suction side axial end face of said rotating shaft;

wherein said rotating impellers include one or more turbine impellers for discharging the sucked gas in said axial direction, and one or more centrifugal impellers, located downstream of said one or more turbine impellers, for further discharging the discharged gas by a centrifugal drag effect, wherein said turbine impeller part and said one or more centrifugal impellers are separately formed, wherein said one or more turbine impellers are included in said turbine impeller part, wherein at least one stage of said one or more centrifugal impellers is a circumferential flow impeller, and wherein the last stage of said one or more turbine impellers is located on the suction side of said suction side axial end face of said rotating shaft in said axial direction.

6. A turbo vacuum pump, comprising:

a suction part for sucking gas in an axial direction;

a discharge section in which rotating impellers and stationary impellers are alternately arranged;

a rotating shaft for rotating said rotating impellers; and a turbine impeller part fixed to a suction side axial end face of said rotating shaft;

wherein said rotating impellers include one or more turbine impellers for discharging the sucked gas in said axial direction, and one or more centrifugal impellers, located downstream of said one or more turbine impellers, for further discharging the discharged gas by a centrifugal drag effect, wherein said turbine impeller part and said one or more centrifugal impellers are separately formed, wherein said one or more turbine impellers are included in said turbine impeller part, wherein said turbine impeller part has a discharge side axial end face in contact with said suction side axial end face, and has an annular projection formed on said discharge side axial end face for receiving said rotating shaft, and wherein an inside diameter of said annular projection is equal to an outside diameter of said rotating shaft, whereby said turbine impeller part is enabled to be easily positioned concentrically with said rotating shaft and to be attached to said rotating shaft without being tilted, with its axis coincident with an axis of said rotating shaft.

7. The turbo vacuum pump according to claim 6, wherein at least one stage of said one or more centrifugal impellers is a circumferential flow impeller.

* * * * *